US009027923B2

(12) United States Patent
Suzuki

(10) Patent No.: US 9,027,923 B2
(45) Date of Patent: May 12, 2015

(54) SHEET CONVEYING APPARATUS AND IMAGE FORMING APPARATUS

(75) Inventor: Yohei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 13/252,303

(22) Filed: Oct. 4, 2011

(65) Prior Publication Data

US 2012/0093554 A1 Apr. 19, 2012

(30) Foreign Application Priority Data

Oct. 13, 2010 (JP) ..... 2010-230414

(51) Int. Cl.

| | |
|---|---|
| ***B65H 9/04*** | (2006.01) |
| ***G03G 15/00*** | (2006.01) |
| ***B65H 7/02*** | (2006.01) |
| ***B65H 9/00*** | (2006.01) |
| ***B65H 9/06*** | (2006.01) |
| *G03G 15/23* | (2006.01) |

(52) U.S. Cl.

CPC ..... *G03G 15/6567* (2013.01); *B65H 7/02* (2013.01); *B65H 9/004* (2013.01); *B65H 2404/724* (2013.01); *B65H 2553/412* (2013.01); *B65H 2553/612* (2013.01); *B65H 2801/06* (2013.01); *G03G 2215/00565* (2013.01); *B65H 9/06* (2013.01); *G03G 15/235* (2013.01)

(58) Field of Classification Search

USPC ..... 271/242–246, 176, 258.01, 265.01

See application file for complete search history.

(56) References Cited

U.S. PATENT DOCUMENTS

| | | | | |
|---|---|---|---|---|
| 5,153,655 | A | 10/1992 | Suzuki et al. | |
| 5,157,444 | A | 10/1992 | Mori et al. | |
| 5,233,400 | A * | 8/1993 | Cahill | 399/395 |
| 5,923,140 | A | 7/1999 | Azumi et al. | |
| 6,011,948 | A * | 1/2000 | Amano et al. | 399/395 |
| 6,113,093 | A | 9/2000 | Morinaga et al. | |
| 6,934,505 | B2 | 8/2005 | Shin | |
| 7,077,517 | B2 | 7/2006 | Awai et al. | |
| 7,195,238 | B2 | 3/2007 | Suga et al. | |

(Continued)

FOREIGN PATENT DOCUMENTS

| | | |
|---|---|---|
| CN | 1576210 A | 2/2005 |
| CN | 1766745 A | 5/2006 |

(Continued)

OTHER PUBLICATIONS

Office Action issued in Chinese Application No. 201110308964.9 dated Jan. 27, 2014.

*Primary Examiner* — Thomas Morrison

(74) *Attorney, Agent, or Firm* — Fitzpatrick, Cella, Harper & Scinto

(57) ABSTRACT

A sheet conveying apparatus includes: a conveying unit nipping a sheet in a nip portion to convey the sheet; a shutter unit rotated in a predetermined rotation direction by being pushed by the conveyed sheet to correct a skew of the sheet; a rotation transmitting unit configured to transmit a rotational driving force to the shutter unit to rotate the shutter unit in the predetermined rotation direction; and an urging unit configured to apply an urging force to the shutter unit so that the shutter unit comes into contact with a surface of the sheet, thereafter the shutter unit is returned to a waiting position along with the passage of a rear end of the sheet through the shutter unit after the shutter unit is rotated by the rotational driving force of the rotation transmitting unit.

20 Claims, 23 Drawing Sheets

(56) References Cited

U.S. PATENT DOCUMENTS

| | | | | |
|---|---|---|---|---|
| 7,681,822 | B2 | 3/2010 | Tai | |
| 7,681,882 | B2 * | 3/2010 | Yu et al. | 271/243 |
| 8,342,519 | B2 * | 1/2013 | Watanabe et al. | 271/243 |
| 8,387,975 | B2 * | 3/2013 | Suzuki | 271/243 |
| 8,556,259 | B2 * | 10/2013 | Suzuki | 271/243 |
| 2006/0181015 | A1 | 8/2006 | Takahashi | |
| 2010/0276863 | A1 * | 11/2010 | Yano | 271/3.14 |
| 2011/0089628 | A1 * | 4/2011 | Watanabe et al. | 271/110 |

FOREIGN PATENT DOCUMENTS

| | | | |
|---|---|---|---|
| CN | 101412478 | A | 4/2009 |
| JP | H09-183539 | | 7/1997 |
| JP | 3459732 | B2 | 10/2003 |

* cited by examiner

SHEET CONVEYING APPARATUS AND IMAGE FORMING APPARATUS

BACKGROUND OF THE INVENTION

1. Field of the Invention

The present invention relates to a sheet conveying apparatus and an image forming apparatus equipped with the sheet conveying apparatus.

2. Description of the Related Art

Generally, in an image forming apparatus, accuracy of image recording position with respect to a sheet (hereinafter referred to as "recording accuracy") is one of important factors in maintaining image quality. For example, if a sheet conveyed during image formation is skewed, it is necessary to correct the skewed sheet to form an image in an appropriate position. Various sheet conveying apparatus provided with a skew correction function have been proposed for use in conventional image forming apparatus in order to improve recording accuracy (see Japanese Patent Application Laid-Open No. H09-183539).

For example, a sheet conveying apparatus described in Japanese Patent Application Laid-Open No. H09-183539 includes a plurality of conveying roller pairs installed in a sheet width direction orthogonal to a sheet conveying direction, and a rotatable shutter member is placed between the conveying roller pairs on a rotating shaft of conveying rollers. The shutter member has an abutting portion configured to be abutted by a sheet. When a leading end of the sheet abuts the abutting portion, the sheet slacks by the reaction force of the abutting portion, bending into a curve. The formation of the curve causes a leading end portion of the sheet to be adjusted parallel to the sheet width direction orthogonal to the conveying direction, thereby correcting the skew. Subsequently, when the shutter member rotates, the sheet is conveyed with the leading end of the sheet pinched in nip portions of the conveying roller pairs in a state of being parallel to the sheet width direction. That is, the sheet is conveyed with skew corrected.

In these years, further improvements in throughput are demanded of image forming apparatus and there is demand to improve sheet conveying speed and reduce gap (hereinafter referred to as "sheet gap") between the rear end of a preceding sheet and the leading end of a subsequent sheet. Thus, after passage of the preceding sheet, the shutter members need to be returned to home position in the sheet gap which has been reduced.

Shutter members installed in a sheet conveying apparatus regarding the present invention are illustrated in FIGS. 22 and 23. As illustrated in FIGS. 22 and 23, shutter members 423 are rotatably supported on a rotating shaft 418*a* of conveying roller pairs 418, 419. The shutter members 423 are adapted to make a sheet pinched between the conveying pairs by rotating through a nip portion and return to a waiting position by rotating backward. Therefore, a minimum required sheet gap distance D3 is a sum of a distance D1 from a position at which a rear end of a preceding sheet S passes through abutting surfaces of the shutter members 423 to the waiting position (home position of the shutter members) P at which the sheet S undergoes a skew correction and a distance D2 over which a subsequent sheet S is conveyed to the waiting position in the meantime (see FIG. 23).

So long as the shutter members 423 reciprocate through the nip portion of the conveying roller pairs 418, 419, the distance D1 is involved, and it takes time $\Delta t$ for the shutter members 423 to travel the distance D1. The distance D2 equals a distance ($\Delta t \times V$) obtained by multiplying the time $\Delta t$ needed for the shutter members 423 to travel the distance D1 by conveying speed V of the sheet S, meaning that the faster the conveying speed V of the sheet S, the larger the distance. Therefore, the sheet conveying apparatus has a problem in that the sheet gap increases with increases in the conveying speed of the sheet S, limiting further improvements in throughput.

SUMMARY OF THE INVENTION

The present invention provides a sheet conveying apparatus and an image forming apparatus equipped with the sheet conveying apparatus, where the sheet conveying apparatus allows sheet conveying speed to be increased without increasing an sheet gap distance and thereby allows improvements in throughput.

The present invention provides a sheet conveying apparatus including: a conveying unit configured to nip a sheet in a nip portion and to convey the sheet; a shutter unit rotatably provided and having an abutting portion against which a leading end of the sheet conveyed toward the nip portion abuts at a waiting position, wherein the shutter is rotated in a predetermined rotation direction by being pushed by the leading end of the conveyed sheet to correct a skew of the sheet; a rotation transmitting unit configured to transmit a rotational driving force to the shutter unit to rotate the shutter unit in the predetermined rotation direction after the shutter unit rotates until the sheet is nipped in the nip portion with the abutting portion pushed by the leading end of the sheet; and an urging unit configured to apply an urging force to the shutter unit, wherein after the shutter unit is rotated by the rotational driving force of the rotation transmitting unit, the urging unit applies the urging force to the shutter unit so that the shutter unit comes into contact with a surface of the sheet, thereafter the shutter unit is returned to the waiting position along with the passage of a rear end of the sheet through the shutter unit.

The present invention can reduce the time required for the shutter member to go into the waiting position after passage of the sheet, eliminating the need to secure a large sheet gap distance and thereby improving throughput.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

An image forming apparatus equipped with a sheet conveying apparatus according to embodiments of the present invention will be described below with reference to the drawings. The image forming apparatus according to the embodiments of the present invention is a copier, printer, facsimile machine, or multi-function peripheral provided with a skew correction function for correcting skew of a conveyed sheet. An electrophotographic color image forming apparatus 100 adapted to form four-color toner images will be described in the following embodiments.

First Embodiment

Figure 1:
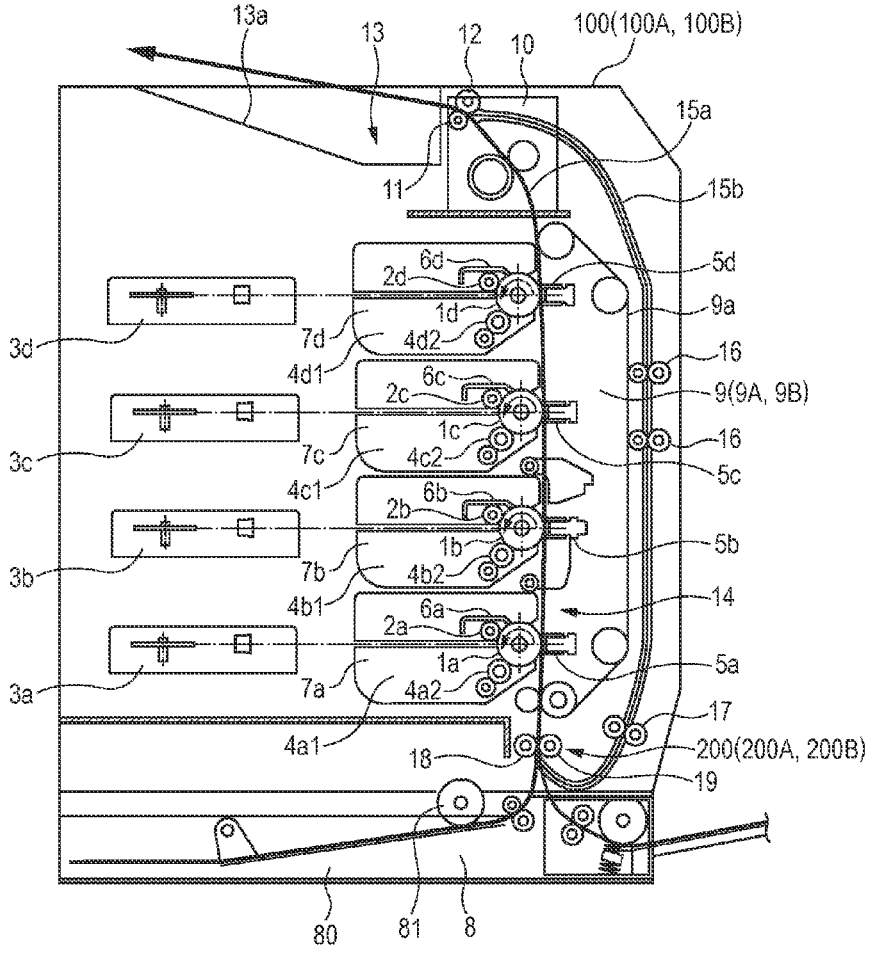
FIG. 1 is a sectional view schematically illustrating an overall structure of an image forming apparatus according to a first embodiment of the present invention.

The image forming apparatus 100 according to a first embodiment of the present invention will be described with reference to FIGS. 1 to 13. An overall structure of the image forming apparatus 100 according to the first embodiment will be described with reference to FIG. 1. FIG. 1 is a sectional view schematically illustrating the overall structure of the image forming apparatus 100 according to the first embodiment of the present invention.

As illustrated in FIG. 1, the image forming apparatus 100 according to the first embodiment includes a sheet feeding unit 8 adapted to feed sheets S, an image forming unit 14 adapted to form toner images, a fixing unit 10 adapted to fix the toner images transferred in an unfixed state, and a sheet conveying unit 9 serving as a sheet conveying apparatus. Also, the image forming apparatus 100 includes a sheet delivery unit 13 adapted to deliver the sheets S on which the toner images have been fixed.

The sheet feeding unit 8 includes a paper feed cassette 80 containing the sheets S, a feed roller 81 adapted to feed the sheets S contained in the paper feed cassette 80 to the sheet conveying unit 9, and a separation unit (not illustrated) adapted to separate the sheets S one by one. The sheet feeding unit 8 feeds the sheets S contained in the paper feed cassette 80 to the sheet conveying unit 9 using the feed roller 81 by separating the sheets S one by one using the separation unit.

The image forming unit 14 forms toner images based on predetermined image information and transfers the toner images to the sheets S conveyed via the sheet conveying unit 9. The image forming unit 14 includes photosensitive drums 1*a*, 1*b*, 1*c* and 1*d*; electrostatic charging units 2*a*, 2*b*, 2*c* and 2*d*; exposure units 3*a*, 3*b*, 3*c* and 3*d*; developing units 4*a*, 4*b*, 4*c* and 4*d*; transfer rollers 5*a*, 5*b*, 5*c* and 5*d*; and cleaning units 6*a*, 6*b*, 6*c* and 6*d*. Also, the image forming unit 14 includes a transfer belt 9*a*.

The photosensitive drums 1*a*, 1*b*, 1*c* and 1*d* serving as image bearing members are each made of an aluminum cylinder whose outer circumferential surface is coated with an organic photoconductor layer (OPC). The photosensitive drums 1*a*, 1*b*, 1*c* and 1*d* are rotatably supported at opposite ends by flanges and rotatably driven counterclockwise in FIG. 1 by a driving force transmitted to one end from a drive motor (not illustrated). The electrostatic charging units 2*a*, 2*b*, 2*c* and 2*d* bring a roller-shaped, electrically conductive roller into abutment against surfaces of the photosensitive drums 1*a*, 1*b*, 1*c* and 1*d* and uniformly charge the surfaces of the photosensitive drums 1*a*, 1*b*, 1*c* and 1*d* by applying a charging bias voltage from a power supply (not illustrated). The exposure units 3*a*, 3*b*, 3*c* and 3*d* form electrostatic latent images on the photosensitive drums 1*a*, 1*b*, 1*c* and 1*d* by irradiating a laser beam based on image information.

The developing units 4*a*, 4*b*, 4*c* and 4*d* include toner containing units 4*a*1, 4*b*1, 4*c*1 and 4*d*1 and developing roller units 4*a*2, 4*b*2, 4*c*2 and 4*d*2. The toner containing units 4*a*1, 4*b*1, 4*c*1 and 4*d*1 contain black, cyan, magenta and yellow toners, respectively. The developing roller units 4*a*2, 4*b*2, 4*c*2 and 4*d*2, which are placed adjacent to photoconductor surfaces, transfer the color toners to the electrostatic latent images on the photosensitive drums 1*a*, 1*b*, 1*c* and 1*d* and visualize the electrostatic latent images into toner images by applying a developing bias voltage.

The transfer rollers 5*a*, 5*b*, 5*c* and 5*d* are placed inside the transfer belt 9*a*, facing the photosensitive drums 1*a*, 1*b*, 1*c* and 1*d*, so as to abut against the transfer belt 9*a*. The transfer rollers 5*a*, 5*b*, 5*c* and 5*d* are connected to a transfer bias power supply (not illustrated) to apply a positive charge to the sheets S from the transfer rollers 5*a*, 5*b*, 5*c* and 5*d* via the transfer belt 9*a*. A resulting electric field causes negatively charged color toner images on the photosensitive drums 1*a*, 1*b*, 1*c* and 1*d* to be transferred in sequence to the sheet S placed in contact with the photosensitive drums 1*a*, 1*b*, 1*c* and 1*d*, to form a color image. The cleaning units 6*a*, 6*b*, 6*c* and 6*d* remove toner remaining on the photosensitive drums 1*a*, 1*b*, 1*c* and 1*d* after the transfer.

According to the present embodiment, the photosensitive drums 1*a*, 1*b*, 1*c* and 1*d*, electrostatic charging units 2*a*, 2*b*, 2*c* and 2*d*, developing units 4*a*, 4*b*, 4*c* and 4*d*, and cleaning units 6*a*, 6*b*, 6*c* and 6*d* are integrated to respectively form process cartridge units 7*a*, 7*b*, 7*c* and 7*d*.

The fixing unit 10 heats the sheets S to which unfixed toner images have been transferred and thereby fixes the unfixed toner images. The sheet delivery unit 13 includes a paper discharging roller pair 11, 12 adapted to convey the sheets S on which an image has been formed, by rotating in normal direction, or reverse the sheet S by rotating in reverse direction; and a delivery portion 13*a* to which the sheets S are delivered.

The sheet conveying unit 9 conveys the sheets S on which a toner image has been formed by the image forming unit 14. The sheet conveying unit 9 includes a sheet conveying path 15*a*, a duplex conveying path 15*b*, an oblique feeding roller pair 16, a U-turn roller pair 17 and a skew correction unit 200.

The sheet conveying path 15*a* is intended to convey the sheets S fed from the sheet feeding unit 8 or the sheets S conveyed from the duplex conveying path 15*b*, and the toner images formed by the image forming unit 14 are transferred to the sheets S at a predetermined location on the sheet conveying path 15*a*. The duplex conveying path 15*b* is intended to convey the sheets S turned over for duplex printing by the paper discharging roller pair 11, 12 to the sheet conveying path 15*a*. The oblique feeding roller pair 16 is placed on the duplex conveying path 15*b* and adapted to convey the sheets S which have been turned over. The U-turn roller pair 17 is placed on the duplex conveying path 15*b* and adapted to re-convey the sheets S conveyed in the duplex conveying path 15*b* to the sheet conveying path 15*a*.

The skew correction unit 200 is installed on the sheet conveying path 15*a* and adapted to apply skew corrections to the sheets S fed from the sheet feeding unit 8 or the sheets S conveyed from the duplex conveying path 15*b* before toner images are transferred to the sheets S.

The sheet S fed from the sheet feeding unit 8 to the sheet conveying path 15*a* is conveyed to the image forming unit 14 with skew corrected by the skew correction unit 200. Toner images are transferred in sequence to the sheet S by the image forming unit 14. Subsequently, the unfixed toner images are fixed by the fixing unit 10 and the sheet S is delivered to the sheet delivery unit 13 by the paper discharging roller pair 11, 12.

In the case of duplex printing, the paper discharging roller pair 11, 12 is rotated in reverse direction after the unfixed toner images are fixed by the fixing unit 10, but before the sheet S is discharged to the sheet delivery unit 13 by the paper discharging roller pair 11, 12. Consequently, the sheet S with the toner images fixed on one surface thereof is conveyed top side down to the duplex conveying path 15*b*. The sheet S conveyed to the duplex conveying path 15*b* is further conveyed to the skew correction unit 200 via the oblique feeding roller pair 16 and U-turn roller pair 17. After skew is corrected by the skew correction unit 200, the sheet S is conveyed again to the image forming unit for duplex printing.

Figure 2A:
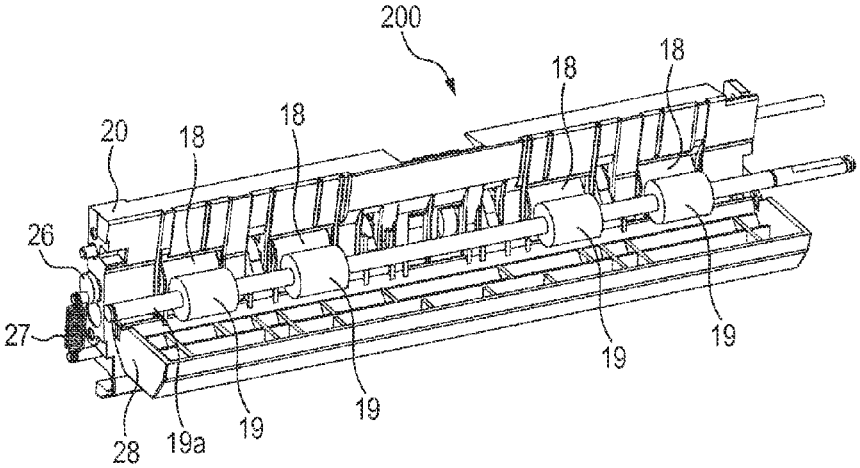
FIG. 2A is a perspective view of a skew correction unit according to the first embodiment, as viewed from the front.
Figure 2B:
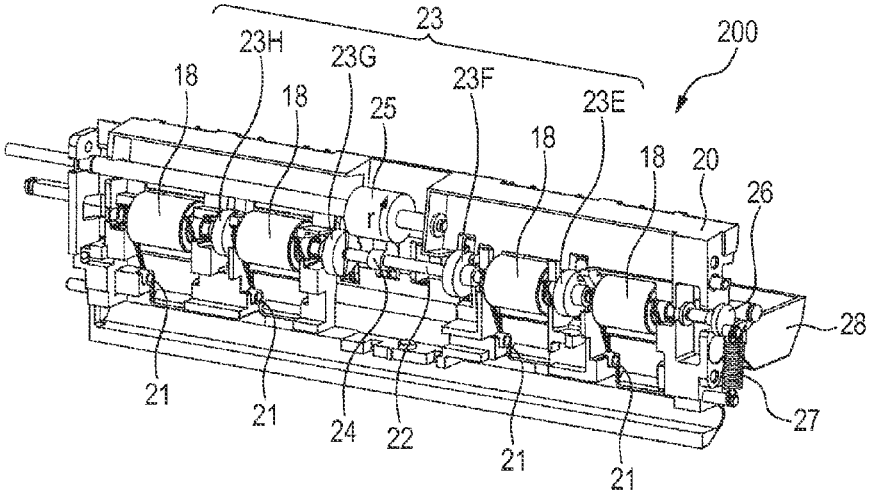
FIG. 2B is a perspective view of the skew correction unit illustrated in FIG. 2A, as viewed from the back.
Figure 3:
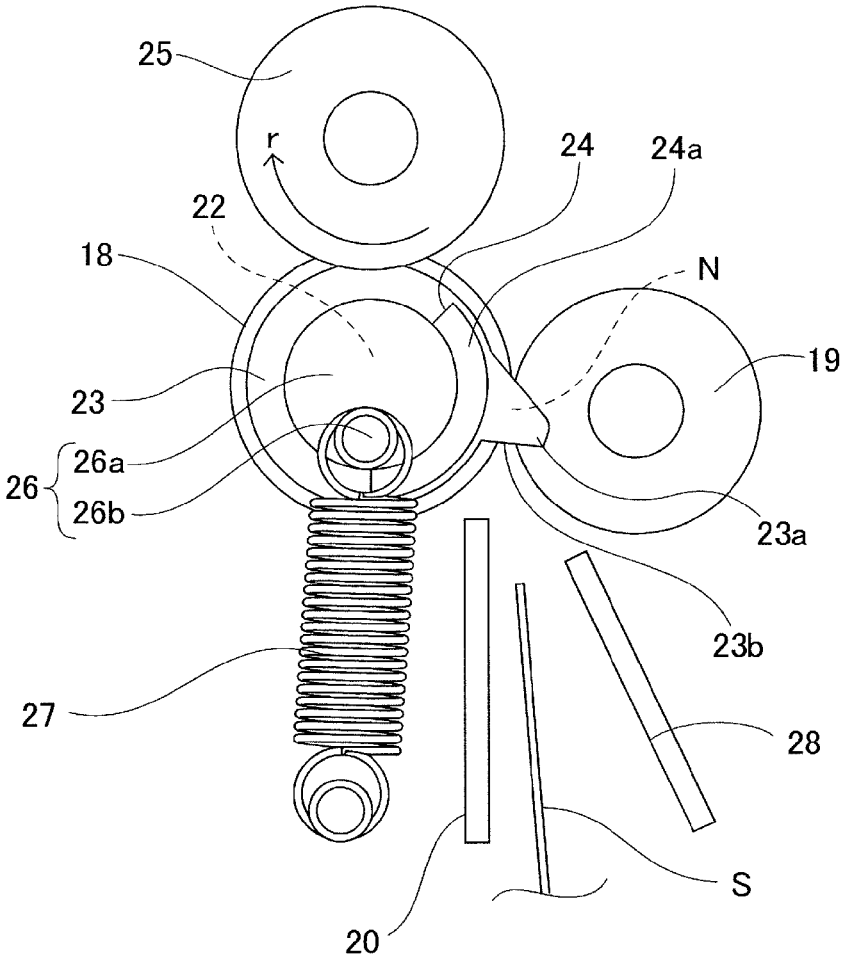
FIG. 3 schematically illustrates a state in which a sheet is conveyed to the skew correction unit according to the first embodiment.

The skew correction unit 200 adapted to correct skew of the sheets S will be described concretely with reference to FIGS. 2A to 3. FIG. 2A is a perspective view of the skew correction unit 200 according to the first embodiment, as viewed from the front. FIG. 2B is a perspective view of the skew correction unit 200 illustrated in FIG. 2A, as viewed from the back. FIG. 3 schematically illustrates a state in which a sheet S is conveyed to the skew correction unit 200 according to the first embodiment.

As illustrated in FIGS. 2A and 2B, the skew correction unit 200 includes conveying roller pairs 18, 19, a paper feed frame 20, conveying rotary member springs 21, a shutter shaft 22, shutter members 23 serving as shutter units, and an assist cam 24 serving as a transmitting unit. Also, the skew correction unit 200 includes a rotation assist roller 25 serving as a rotating unit adapted to generate a driving force, a shutter drive unit 26, a shutter spring 27 serving as an urging unit, and a guide frame 28. According to the present embodiment, a rotation transmitting unit includes the assist cam 24 and the rotation assist roller 25.

Conveying roller pairs 18, 19 include a plurality of conveying rollers 19 and a plurality of conveying rotary members 18, placed facing each other. As illustrated in FIG. 2A, the conveying rollers 19 are fixed to a rotating shaft 19*a* and adapted to rotate integrally with the rotating shaft 19*a*, where the rotating shaft 19*a* is axially supported in parallel to rotating shafts of the photosensitive drums 1*a*, 1*b*, 1*c* and 1*d*. As illustrated in FIG. 2B, the conveying rotary members 18 are rotatably attached to the shutter shaft 22 and urged against the respective conveying rollers 19 by the respective conveying rotary member springs 21 fixed to the paper feed frame 20. By the urging forth, the conveying rotary members act as driven rotary members of the conveying rollers 19 for conveying the sheets S. There is clearance between inner circumferential surfaces of the conveying rotary members 18 and an outer circumferential surface of the shutter shaft 22, and spring forces of the conveying rotary member springs 21 are not transmitted to the shutter shaft 22. Consequently, the spring forces of the conveying rotary member springs 21 do not obstruct rotating operation of the shutter members 23 and assist cam 24 fixed integrally with the shutter shaft 22.

The shutter shaft 22 is rotatably supported by the paper feed frame 20 parallel to a direction of the rotating shafts of the photosensitive drums 1*a*, 1*b*, 1*c* and 1*d*. A plurality of the shutter members 23E, 23F, 23G and 23H is fixed to the shutter shaft 22. As illustrated in FIG. 3, each of the shutter members 23 has a substantially cylindrical shape with an abutting portion 23*a* formed on an outer circumferential surface. The shutter members 23 are made of a resin such as POM or an elastic material such as silicon rubber. The abutting portions

23*a* form protrusions so as to pass lateral sides of nip portions N of the conveying roller pairs 18, 19 serving as a conveying unit, during rotation of the shutter members 23 and restrain the sheet S by abutting against a leading end of the sheet S before the sheet S is pinched in the nip portions N of the conveying roller pairs 18, 19. That is, the abutting portions 23*a* restrain the sheet S by abutting against the leading end of the sheet S on the upstream side in a sheet conveying direction.

Each abutting portion 23*a* has an abutting surface 23*b* abutted by the leading end of the sheet S. When the abutting portion 23*a* is located at such a position (hereinafter also referred to as "waiting position") that the abutting surface 23*b* will be brought in contact with the leading end of the sheet S, the abutting surface 23*b* is designed to be located upstream of the conveying roller pair 18, 19 in the sheet conveying direction. Hereinafter, the position of the shutter member 23, for abutting the leading end of the sheet S against the abutting surface 23*b*, where the abutting portion 23*a* is placed at the waiting position (see FIG. 3), will be referred to as waiting position of the shutter member 23. The urging force of the shutter spring 27 acts to maintain that the shutter member 23 is located in the waiting position.

The assist cam 24 is formed into an approximate fan-shape and includes an engaging portion 24*a* adapted to be able to engage with the rotation assist roller 25. The assist cam 24 is fixed to the shutter shaft 22 so that the rotation assist roller 25 will rotate in engagement with the engaging portion 24*a* after the abutting portions 23*a* is pushed by the sheet S, the shutter members 23 is rotated, and the sheet S is pinched in the nip portions N of the conveying rollers pair 18, 19. The engaging portion 24*a* of the assist cam 24 is engaged with the rotation assist roller 25 until a driving protrusion 26*b* (described later) of the shutter drive unit 26 swings and passes a top dead center.

The rotation assist roller 25 is rotatably supported by the paper feed frame 20 parallel to a direction of the rotating shafts of the photosensitive drums 1*a*, 1*b*, 1*c* and 1*d*. Also, the rotation assist roller 25 is supported by a rotating shaft and rotates in the direction of an arrow r illustrated in FIGS. 2B and 3 by being driven by a drive unit (motor) which is not illustrated.

The shutter drive unit 26 includes a disk-shaped drive base unit 26*a* connected to an end of the shutter shaft 22, and the driving protrusion 26*b* on which one end of the shutter spring 27 is attached. The drive base unit 26*a* rotates together with the shutter shaft 22, being coupled to the shutter shaft 22 such that a central axis of the drive base unit 26*a* will coincide with the shutter shaft. The driving protrusion 26*b* is attached on top face of the drive base unit 26*a* so as to swing around the shutter shaft 22 and along an outer circumference of the drive base unit 26*a* when the drive base unit 26*a* rotates along with rotation of the shutter shaft 22. Also, the driving protrusion 26*b* is attached on the drive base unit 26*a* such that the abutting portions 23*a* of the shutter members 23 will be located at the waiting position, i.e., the shutter members 23 will be located at the waiting position, at a bottom dead center.

One end of the shutter spring 27 is attached on the driving protrusion 26*b*, and the other end of the shutter spring 27 is attached on the paper feed frame 20. The shutter spring 27 is adapted to urge the driving protrusion 26*b* which swings and thereby place the abutting portions 23*a* in the waiting position. That is, the shutter spring 27 urges the driving protrusion 26*b* so as to place the abutting portions 23*a* in the waiting position at the bottom dead center of the driving protrusion 26*b*.

The paper feed frame 20 and guide frame 28 make up a sheet conveying path adapted to guide the sheets S to the conveying roller pairs 18, 19 on the upstream side of the shutter members 23. Also, while regulating both ends of the sheet S in thickness direction of the sheet S, the paper feed frame 20 and guide frame 28 are separated from each other by a predetermined distance to allow the sheet S to bend in the thickness direction of the sheet S after the sheet S abuts against the abutting surfaces 23*b*. According to the present embodiment, a predetermined curve formation space 32 (see FIG. 6) is provided around the sheet S between the sheet S and guide frame 28.

Figure 4:
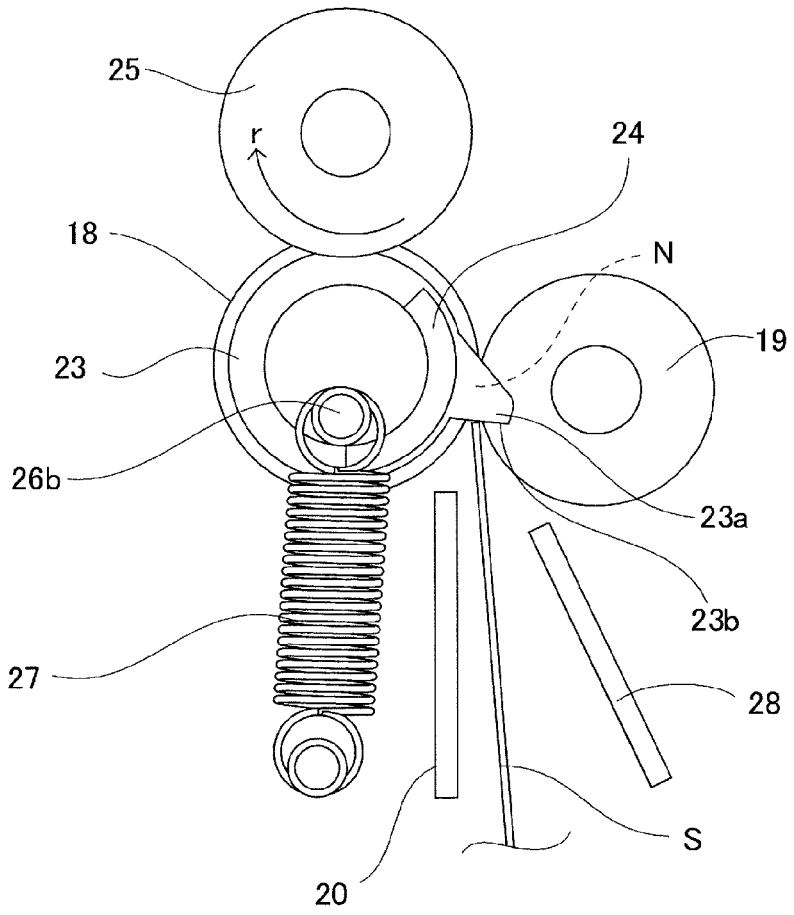
FIG. 4 schematically illustrates a state in which the sheet hits an abutting portion of a shutter member after being conveyed to the skew correction unit according to the first embodiment.
Figure 5:
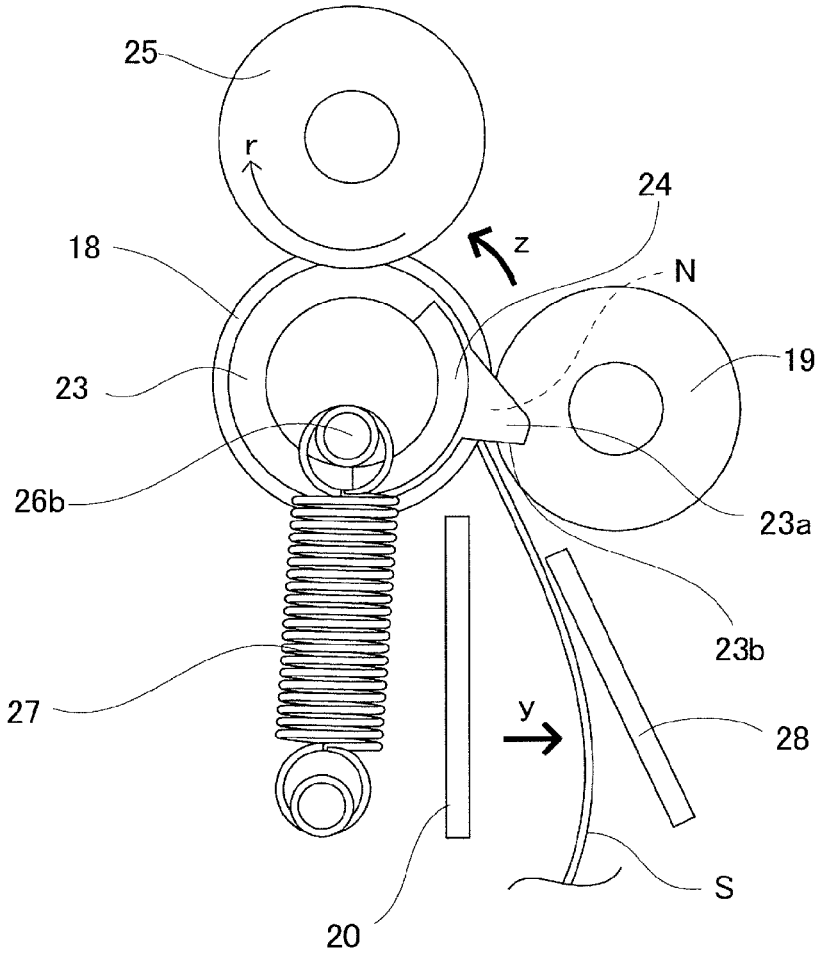
FIG. 5 schematically illustrates a state in which the sheet hits the abutting portion of the shutter member, bends and forms a curve.
Figure 6:
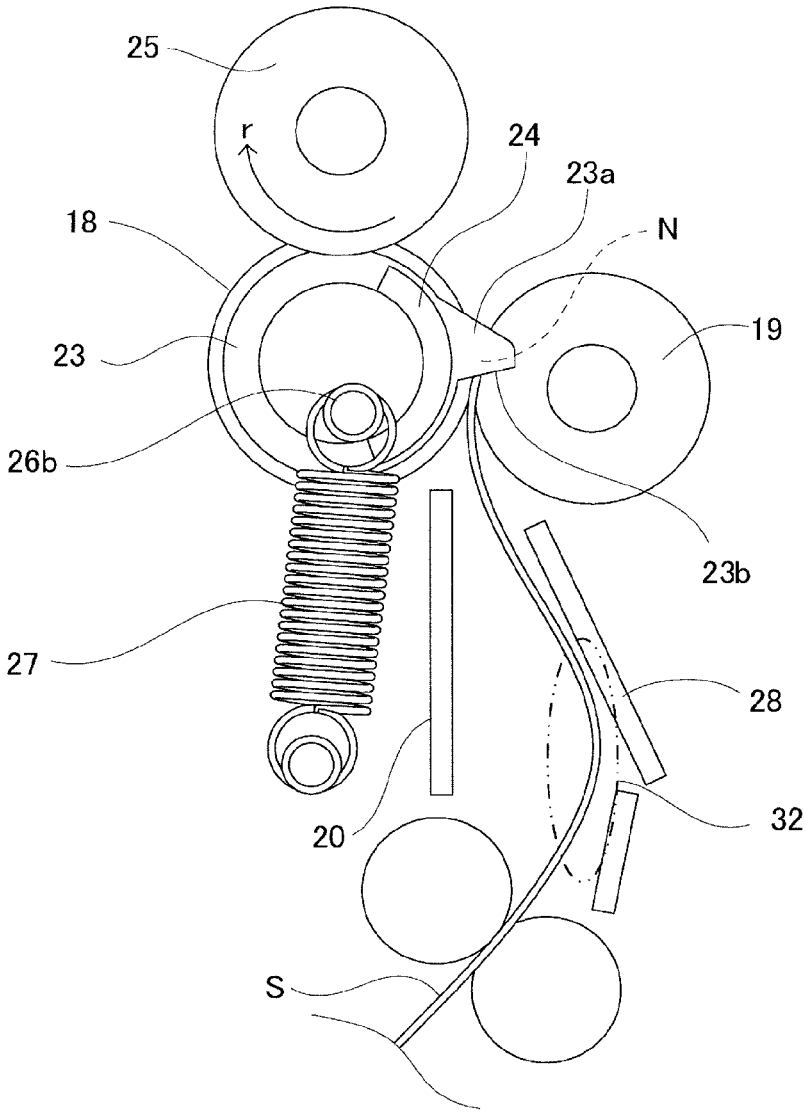
FIG. 6 schematically illustrates a state in which the shutter member rotates by being pushed by the sheet hitting the abutting portion of the shutter member.
Figure 7:
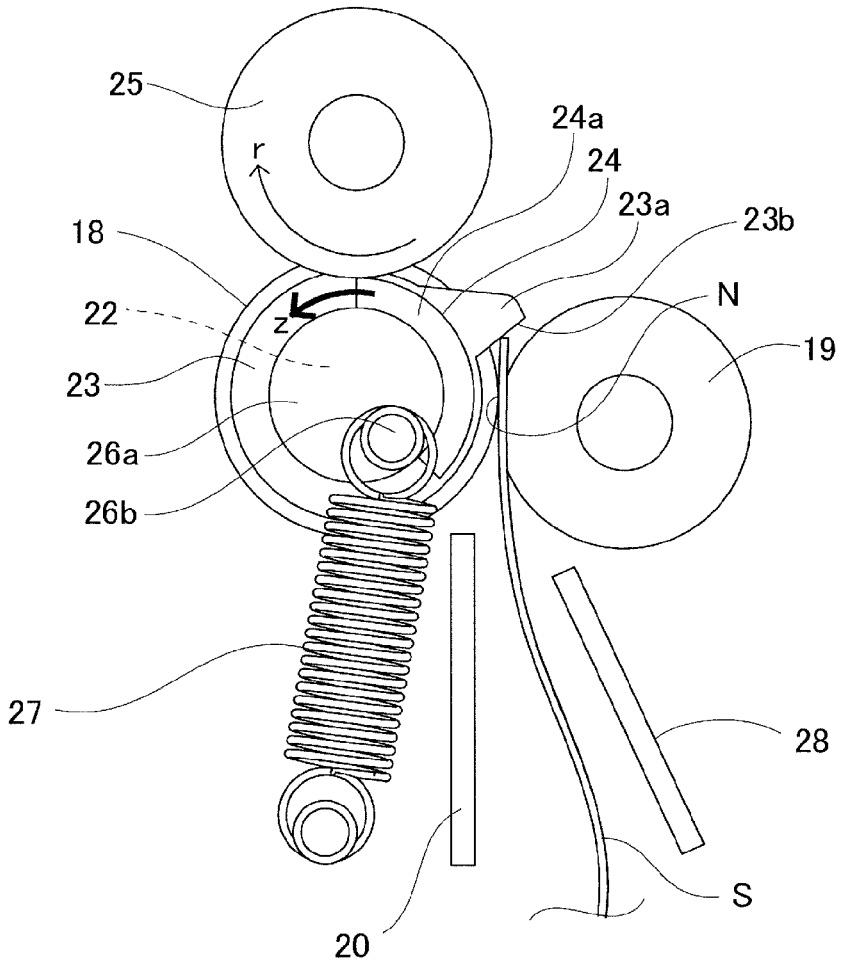
FIG. 7 schematically illustrates a state in which the shutter member is rotated by a rotation assist roller engaged with an assist cam.

Next, operation of the skew correction unit 200 will be described with reference to FIGS. 3, and 4 to 12. FIG. 4 schematically illustrates a state in which the sheet S hits the abutting portion 23*a* of the shutter member 23 after being conveyed to the skew correction unit 200 according to the first embodiment. FIG. 5 schematically illustrates a state in which the sheet S hitting the abutting portion 23*a* of the shutter member 23 bends and forms a curve. FIG. 6 schematically illustrates a state in which the shutter member 23 rotates by being pushed by the sheet S hitting the abutting portion 23*a* of the shutter member 23. FIG. 7 schematically illustrates a state in which the shutter member 23 is rotated by the rotation assist roller 25 engaged with the assist cam 24.

Figure 8:
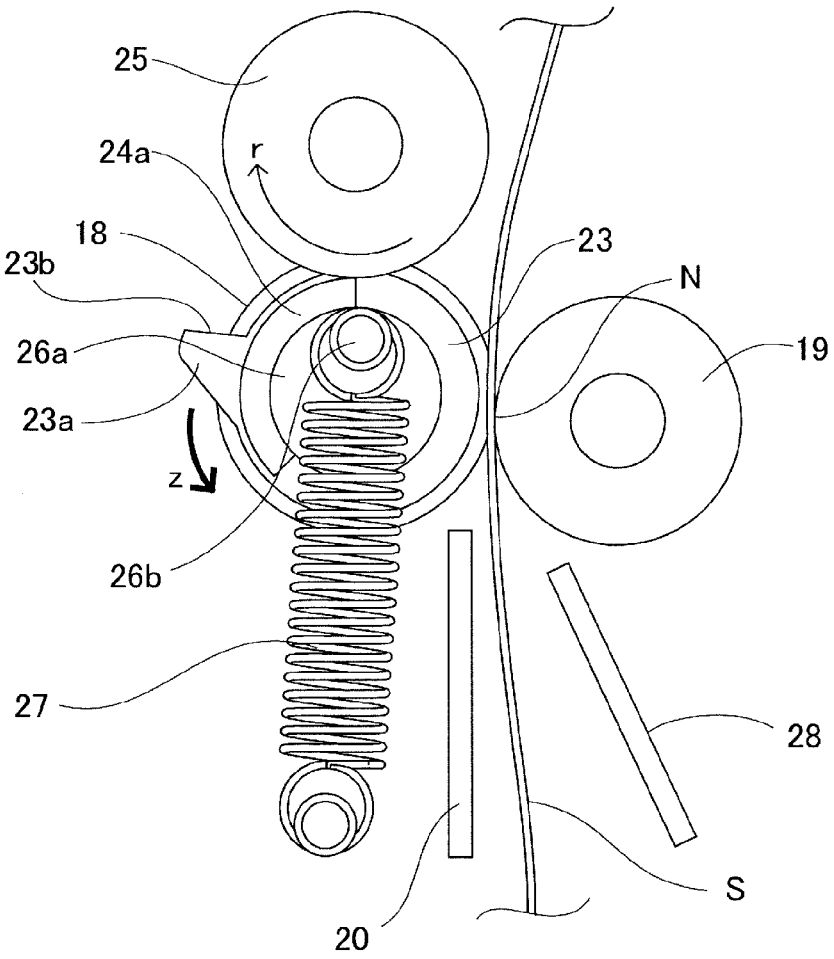
FIG. 8 schematically illustrates a state in which the shutter member is rotated by an urging force of a shutter spring when the rotation assist roller is disengaged from the assist cam.
Figure 9:
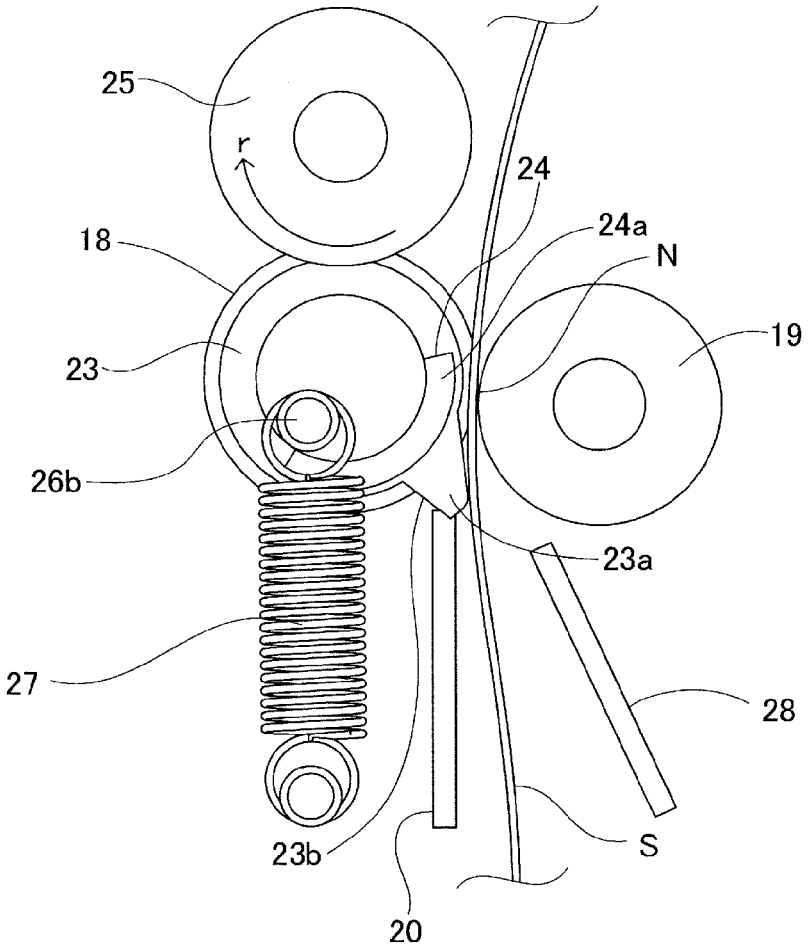
FIG. 9 schematically illustrates a state in which the shutter member rotates, causing the abutting portion to abut against a surface of the sheet conveyed by the conveying roller pair.
Figure 10:
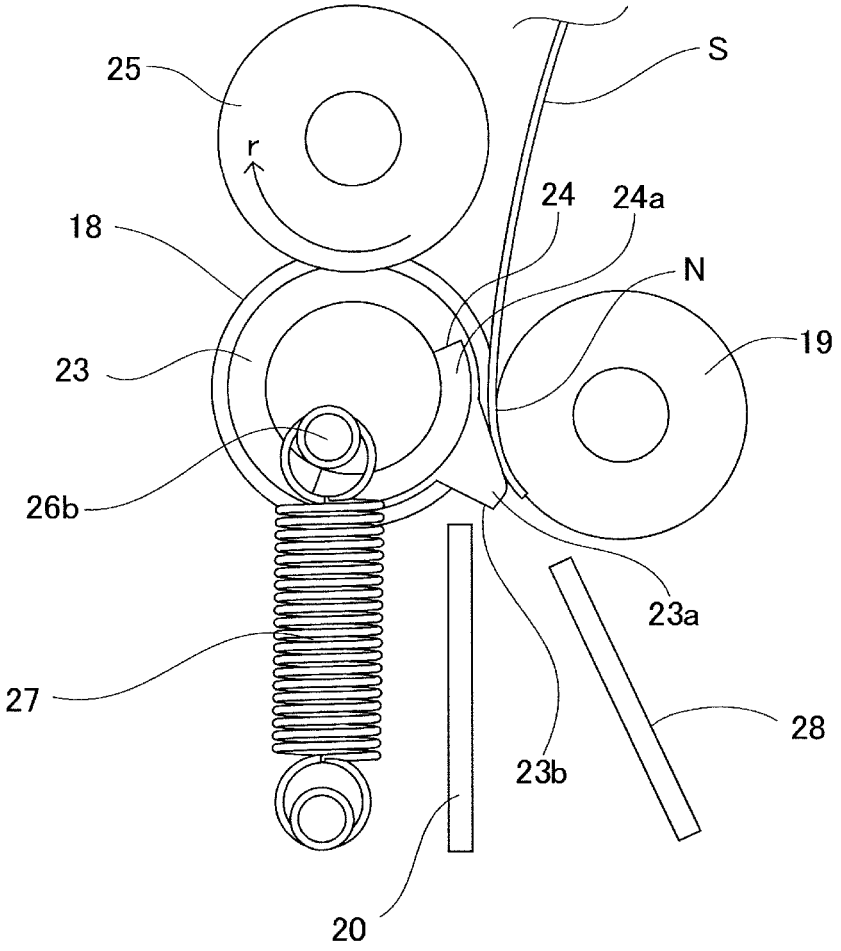
FIG. 10 schematically illustrates a state in which the sheet conveyed by the conveying roller pair passes through the shutter member.
Figure 11:
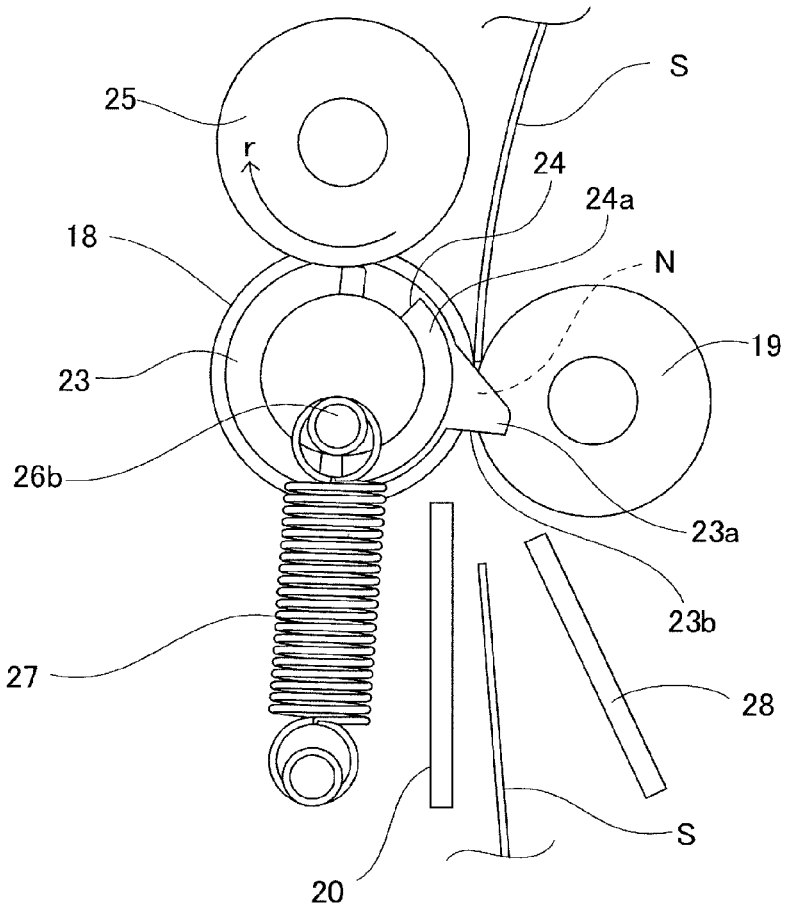
FIG. 11 schematically illustrates a state in which the abutting portion goes into a waiting position after the sheet conveyed by the conveying roller pair passes through the shutter member.
Figure 12:
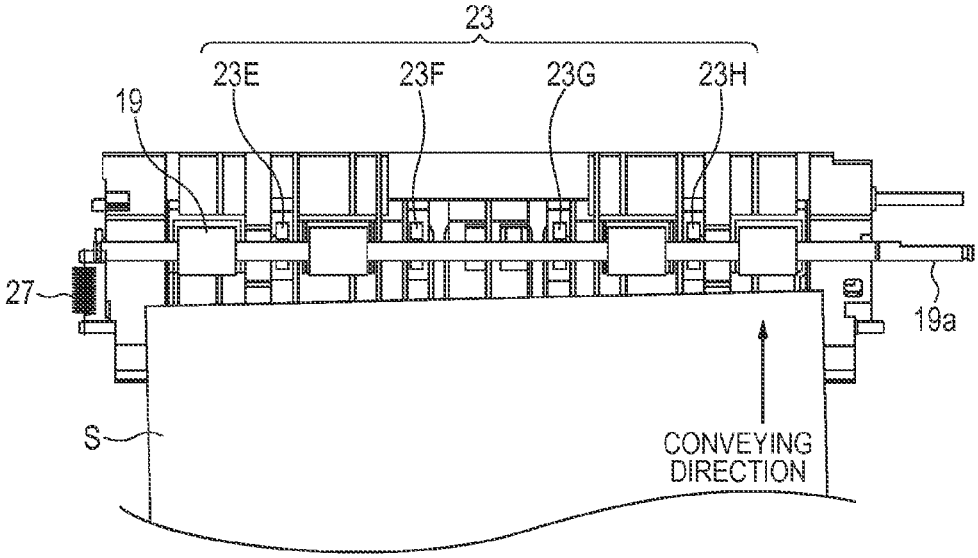
FIG. 12 illustrates a state in which a skewed sheet is conveyed.

FIG. 8 schematically illustrates a state in which the shutter member 23 is rotated by an urging force of the shutter spring 27 when the rotation assist roller 25 is disengaged from the assist cam 24. FIG. 9 schematically illustrates a state in which the shutter member 23 rotates, causing the abutting portion 23*a* to abut against a surface of the sheet S conveyed by the conveying roller pair 18, 19. FIG. 10 schematically illustrates a state in which the sheet S conveyed by the conveying roller pair 18, 19 passes through the waiting position. FIG. 11 schematically illustrates a state in which the abutting portion 23*a* goes into the waiting position after the sheet S conveyed by the conveying roller pair 18, 19 passes through the waiting position. FIG. 12 illustrates a state in which a skewed sheet S is conveyed.

When the sheet S conveyed by the sheet feeding unit 8 comes askew into the conveying roller pairs 18, 19, for example, as illustrated in FIG. 12, if there is no shutter member 23 fixed to the shutter shaft 22, the sheet S will be conveyed maintaining the skewed posture. When the sheet S reaches the image forming unit 14 in the skewed state, toner images to be transferred to the sheet S are transferred to the sheet S at an angle with the sheet S. According to the present embodiment, since the plurality of shutter members 23 fixed to the shutter shaft 22 are configured and arranged as described above, skew of the sheet S is corrected by the action described later, preventing the toner images from being transferred to the sheet S at an angle.

First, a leading end portion on the leading side (e.g., the right side in FIG. 12) of the skewed sheet S comes into contact with the abutting surface 23*b* of the abutting portion 23*a* of the shutter member 23 located at the position (e.g., on the right side in FIG. 12) corresponding to the leading end portion. At this point, the shutter members 23 are waiting at the waiting position as illustrated in FIG. 3 in order for the leading end of the sheet to be adjusted by the urging force of the shutter spring 27. In this state, since the sheet S is not in contact with the abutting surfaces 23*b*, the leading end of the sheet S is conveyed without bending.

Next, when the leading end of the sheet S comes into contact with the abutting surfaces 23*b* as illustrated in FIG. 4, the sheet S receives a holding force of the driving protrusion 26*b* urged by the shutter spring 27 as well as inertial forces and the like of the shutter shaft 22, a plurality of shutter members 23 and assist cam 24 as reaction forces. At this point, the leading end of the sheet S cannot swing by pushing the shutter members 23 against the reaction forces.

Next, when the sheet feeding unit 8 conveys the sheet S further, the leading end portion on the leading side of the sheet S is restrained in abutment with the abutting surface 23*b* of the shutter member 23, and then leading end portion on the succeeding side of the sheet S is restrained by coming into abutment with the abutting surfaces 23*b* of the plurality of shutter members 23 in sequence. That is, the succeeding side of the sheet S abuts against the shutter member 23H, shutter member 23G, shutter member 23F and shutter member 23E in sequence.

In the course of this process, as illustrated in FIG. 5, the sheet S forms a curve bend in the direction of an arrow y in the curve formation space 32 created by the upstream side guide frame 28 and the paper feed frame 20 in the vicinity of the conveying roller pairs 18, 19. The curve formed by the bend sheet S is larger on the right side than on the left side in FIG. 12. The series of movements cause the leading end of the sheet S to align with the abutting surfaces 23*b* of the shutter members 23 and thereby become parallel to the rotating shafts of the conveying roller pairs 18, 19. Consequently, the skew of the sheet S is corrected.

Next, when the sheet S forms a predetermined curve, a pressing force is generated by stiffness of the sheet S, causing the shutter members 23, assist cam 24 and driving protrusion 26*b* to swing around the shutter shaft 22 in the direction of an arrow z illustrated in FIG. 5. Consequently, as illustrated in FIG. 6, the plurality of shutter members 23, assist cam 24 and driving protrusion 26*b* swing by being pushed by the sheet S. While the shutter members 23 are rotating, the leading end of the sheet S is pinched in the nip portions N of the conveying roller pairs 18, 19, and then the sheet S is conveyed by the conveying roller pairs 18, 19.

Skew correction capacity of the skew correction unit 200 increases with increases in the size of the curve formed in the curve formation space 32 created by the guide frame 28 and paper feed frame 20. That is, as illustrated in FIG. 6, it is desirable to increase the size of the curve formation space 32. When a curve is formed in the curve formation space 32 and part of the curve comes into contact with the guide frame 28, apparent stiffness of the sheet S is increased, making it easier to push up the shutter members 23.

Next, as illustrated in FIG. 7, when the shutter members 23 swing until the leading end of the sheet S is pinched in the nip portions N of the conveying roller pairs 18, 19, the engaging portion 24*a* of the assist cam 24 comes into engagement with the rotation assist roller 25. The assist cam 24 with the engaging portion 24*a* engaged with the rotation assist roller 25 rotates around the shutter shaft 22 in the direction of the arrow z (in the same direction as the rotation direction when pushed by the leading end of the sheet S) under the rotational driving force of the rotation assist roller 25 in the direction of r. Consequently, the plurality of shutter members 23 and shutter drive unit 26 fixed to the shutter shaft 22 rotate in the z direction as well. The force which rotates the shutter members 23 is switched from the pressing force of the sheet S to the rotational driving force of the rotation assist roller 25 at the point when the engaging portion 24*a* of the assist cam 24 comes into engagement with the rotation assist roller 25, and the abutting surfaces 23*b* of the shutter members 23 separate from the leading end of the sheet S.

Next, as illustrated in FIG. 8, the driving protrusion 26*b* swings, and almost at the same time as the driving protrusion 26*b* passes the top dead center, the engaging portion 24*a* of the assist cam 24 is separated from the rotation assist roller 25. Thus, the engaging portion 24*a* of the assist cam 24 is disengaged from the rotation assist roller 25. Once the engaging portion 24*a* is disengaged from the rotation assist roller 25, the shutter members 23 rotate further in the direction of the arrow z by the urging force of the shutter spring 27 acting on the driving protrusion 26*b* which has passed the top dead center (i.e., by the urging force tending to return to the waiting position).

The shutter members 23 which have rotated past the top dead center tend to return to the waiting position illustrated in FIG. 3 due to a rotational force produced by the shutter spring 27 as illustrated in FIG. 9, but cannot rotate anymore because there is a conveying sheet S (i.e., a sheet S passing through the waiting position). A state (position) in which the rotation of the shutter members 23 is restricted by coming into abutment with the surface of the passing sheet S is referred to as a sheet passage position of the shutter members 23. Then, as illustrated in FIG. 10, as a rear end of the sheet S passes through the shutter members 23, the shutter members 23 rotate to the waiting position illustrated in FIG. 3 together with the assist cam 24 and shutter drive unit 26, and the abutting portions 23*a* are placed in the waiting position as illustrated in FIG. 11.

As the states illustrated in FIGS. 3 to 11 are repeated, the shutter members 23, assist cam 24 and shutter drive unit 26 fixed to the shutter shaft 22 rotate along with the shutter shaft 22. As the sheets S are fed one after another, the abutting surfaces 23*b* return from the sheet passage position to the waiting position in the sheet gap between the preceding sheet S and subsequent sheet S, restrain the leading end of the subsequent sheet S fed newly, and thereby correct skew of the sheet S.

Figure 13:
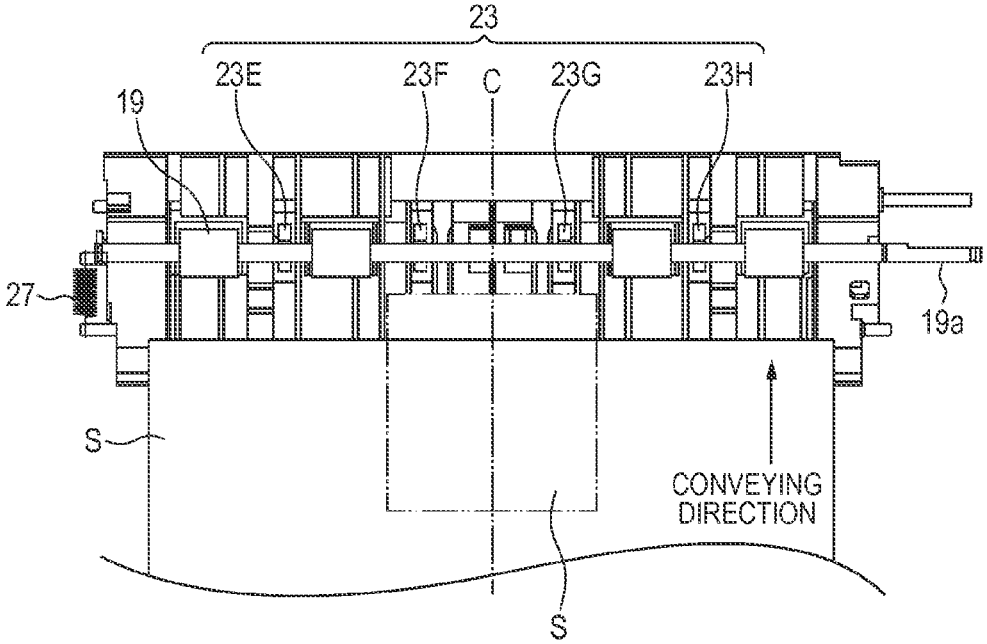
FIG. 13 illustrates a state in which sheets differing in sheet width are conveyed.

Skew correction in cases where the length of the used sheet S in a direction orthogonal to the sheet conveying direction (hereinafter referred to as "width of the sheet S") is relatively large and in cases where the width of the sheet S is relatively small will be described with reference to FIG. 13. FIG. 13 illustrates a state in which sheets differing in sheet width are conveyed.

When the width of the sheet S is relatively large (the sheet S indicated by a solid line in FIG. 13), mainly two shutter members 23E and 23H placed close to both lateral ends of the sheet S act on the leading end of the sheet S, and correct skew of the sheet S. When the width of the used sheet S is relatively small and the sheet S is not large enough to extend over the shutter members 23E and 23H (the sheet S indicated by a dotted line in FIG. 13), skew of the sheet S is corrected by the shutter members 23F and 23G placed inside the shutter members 23E and 23H.

For obtaining more accurate skew correction performance of the sheet S, desirably the shutter members 23 arranged along the width of the sheet S are spaced as widely as possible and placed substantially symmetrically with respect to the widthwise center of the sheet S. This is intended to reduce correction angle errors at the leading end of the sheet S in the direction of the rotating shafts of the conveying roller pairs 18, 19.

Thus, shutter members 23 are placed in the vicinity of both ends of the conveyed sheet S, but shutter members 23 can also be placed in the vicinity of a conveying center C of the sheet S so that skew correction can be applied even to a relatively narrow sheet S. In this point, spacing between the two shutter members 23F and 23G placed in the vicinity of the conveying center C can be made smaller than minimum width of the sheet S. In that case, the abutting surfaces 23*b* of the shutter members 23F and 23G which abut the leading end of the sheet can be placed slightly downstream of the shutter members 23E and 23H in the sheet conveying direction. Consequently, when a wide sheet S is corrected, since the shutter members 23F and 23G are prevented from contacting with the leading end of the sheet S, correction angle errors can be reduced.

By reducing the distance between the abutting surfaces 23*b* and the nip portions N of the conveying roller pairs 18, 19, just after a skew correction by the shutter members 23, the sheet S is pinched in the nip portions N of the conveying roller pairs 18, 19 and conveyed. Consequently, effects of the skew correction of the sheet S can be maintained.

With the above-described configuration, the image forming apparatus 100 according to the first embodiment provides the following advantages. The skew correction unit 200 according to the first embodiment rotates the shutter members 23 in the direction in which the shutter members 23 are pushed by the sheet, and the shutter members 23 remain in the sheet passage position (see FIG. 9) at which the abutting portions 23*a* come in contact with the surface of the passing sheet on upstream side of the waiting position until the sheet passes through the shutter members 23. As the sheet passes through the shutter members 23, the abutting portions 23*a* are brought to the waiting position. Consequently, the time needed for the shutter members to return from the sheet passage position to the waiting position can be reduced compared to when the shutter members are reciprocated. Thus, increasing of a sheet gap distance can be suppressed when conveying speed of the sheet S is increased, and the abutting portions 23*a* can return to the waiting position under conditions of high sheet conveying speed and short sheet gap, which is something difficult conventionally. This in turn allows improvements in throughput.

For example, the first embodiment can approximately halve the sheet gap in comparison to conventional shutter members which perform reciprocating motion, meeting user demand for further improvements in the throughput of image forming apparatus. The assist cam, which assists the rotating operation, eliminates the need to apply an urging force to the leading end of the sheet after skew correction and thereby prevents the leading end of the sheet from damage such as flaws or curling.

According to the first embodiment, the rotational driving force is transmitted to the shutter members 23 by means of the assist cam 24 and rotation assist roller 25 and the shutter members are returned to the waiting position by using the urging force of the shutter spring 27. Thus, the rotational driving force can be transmitted to the shutter members using a simple configuration. This enables reductions in manufacturing costs and the like resulting in suppression of production costs.

In the skew correction unit 200 according to the first embodiment, the rotation center of the plurality of shutter members 23E, 23F, 23G and 23H is placed on the same axis as the rotation center of the conveying rotary members 18. This enables downsizing the skew correction unit 200, and thereby enables downsizing the image forming apparatus 100 or saving space in image forming apparatus 100.

Second Embodiment

Figure 14A:
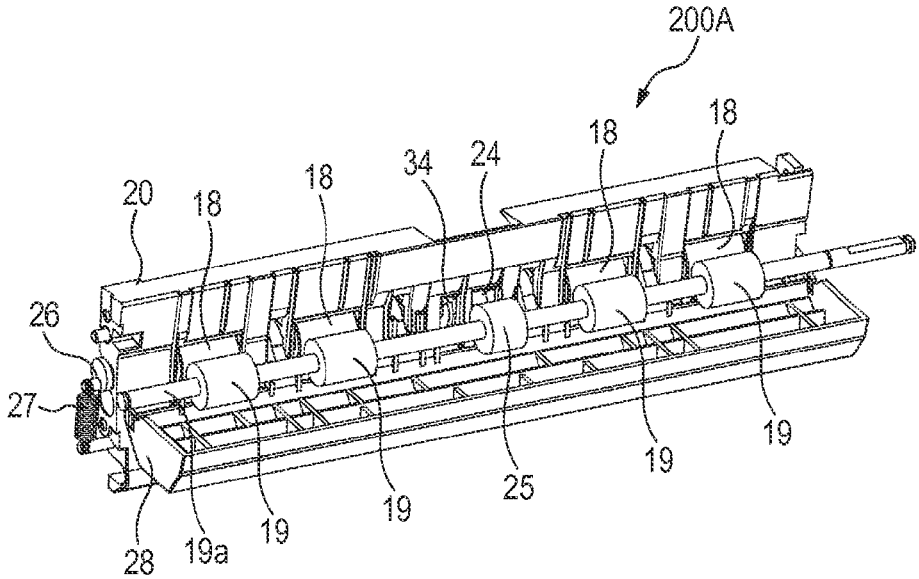
FIG. 14A is a perspective view of a skew correction unit according to a second embodiment, as viewed from the front.
Figure 14B:
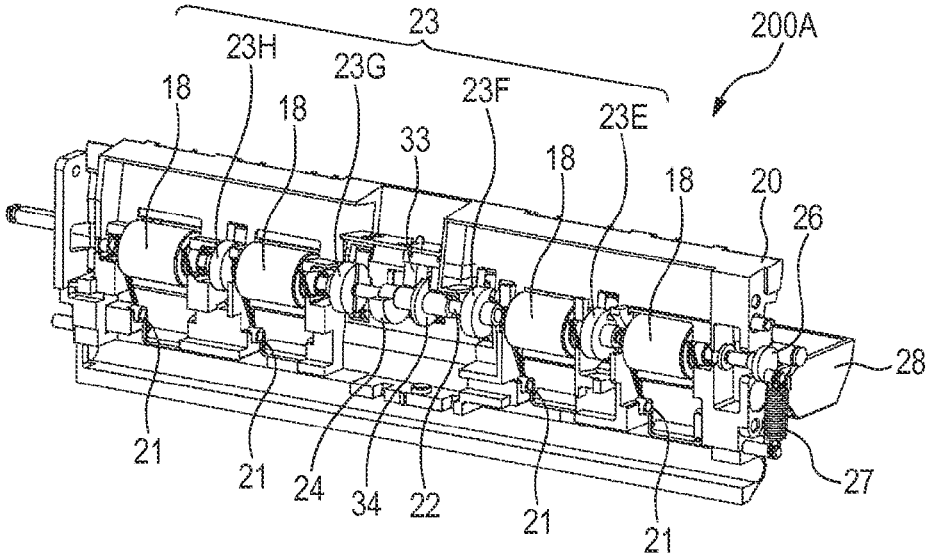
FIG. 14B is a perspective view of the skew correction unit illustrated in FIG. 14A, as viewed from the back.
Figure 15A:
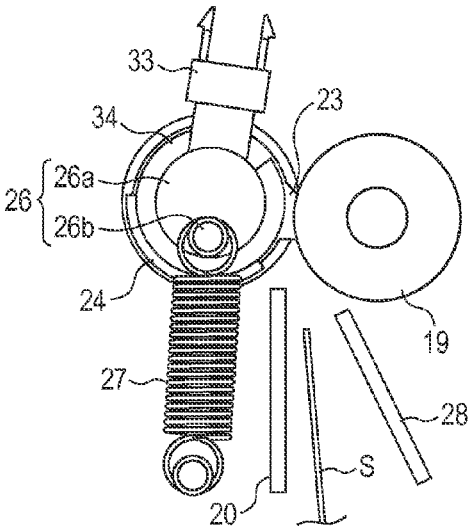
FIG. 15A illustrates a state of a shutter spring and shutter drive member when a sheet is conveyed to the skew correction unit according to the second embodiment.
Figure 15B:
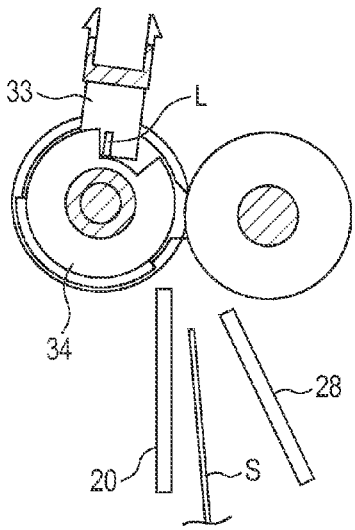
FIG. 15B illustrates a detection member.
Figure 15C:
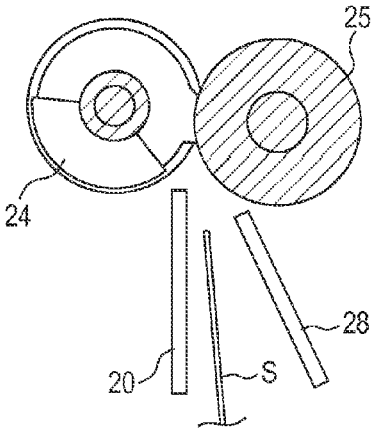
FIG. 15C illustrates a state of the assist cam and rotation assist roller.
Figure 15D:
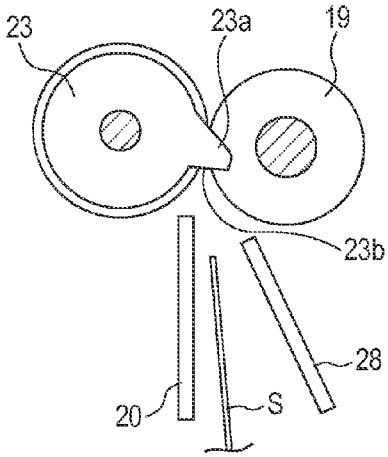
FIG. 15D illustrates a shutter member.

An image forming apparatus 100A according to a second embodiment of the present invention will be described with reference to FIGS. 14A to 16D and with the aid of FIG. 1. FIG. 14A is a perspective view of a skew correction unit 200A according to the second embodiment, as viewed from the front. FIG. 14B is a perspective view of the skew correction unit 200A illustrated in FIG. 14A, as viewed from the back. FIG. 15A illustrates a state of the shutter spring 27 and shutter drive unit 26 when a sheet S is conveyed to the skew correction unit 200A according to the second embodiment. FIG. 15B illustrates a detection member 34 when a sheet S is conveyed to the skew correction unit 200A according to the second embodiment. FIG. 15C illustrates a state of the assist cam 24 and rotation assist roller 25 when a sheet S is conveyed to the skew correction unit 200A according to the second embodiment. FIG. 15D illustrates a shutter member 23 when a sheet S is conveyed to the skew correction unit 200A according to the second embodiment.

Figure 16A:
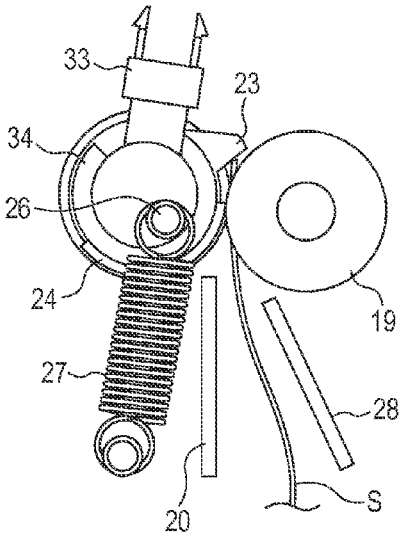
FIG. 16A illustrates a state of the shutter spring and shutter drive member when the shutter member starts to rotate with the rotation assist roller engaged with the assist cam.
Figure 16B:
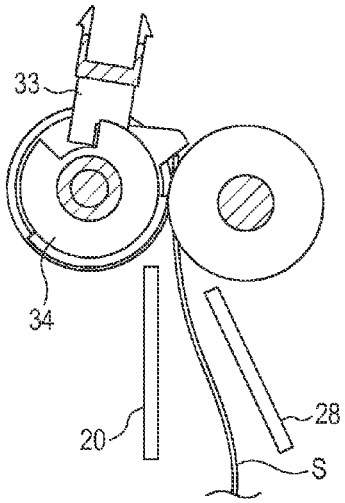
FIG. 16B illustrates the detection member.
Figure 16C:
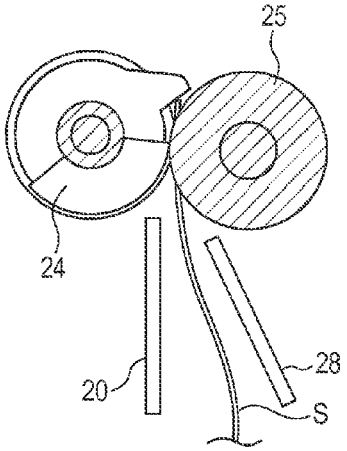
FIG. 16C illustrates a state of the assist cam and rotation assist roller.
Figure 16D:
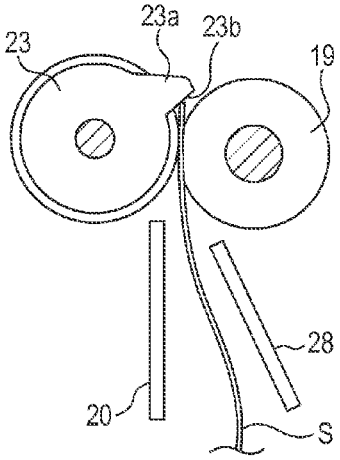
FIG. 16D illustrates the shutter member.

FIG. 16A illustrates a state of the shutter spring 27 and shutter drive unit 26 when a shutter member starts to rotate with the rotation assist roller 25 engaged with the assist cam 24. FIG. 16B illustrates the detection member 34 when the shutter member 23 starts to rotate with the rotation assist roller 25 engaged with the assist cam 24. FIG. 16C illustrates a state of the assist cam 24 and rotation assist roller 25 when the shutter member 23 starts to rotate with the rotation assist roller 25 engaged with the assist cam 24. FIG. 16D illustrates the shutter member 23 when the shutter member 23 starts to rotate with the rotation assist roller 25 engaged with the assist cam 24.

In the skew correction unit 200A according to the second embodiment, the rotation assist roller 25 is placed on the rotating shaft 19*a*. Besides, the second embodiment differs from the first embodiment in that the detection member 34 serving as a rotation detection unit is installed on the shutter shaft 22 and that a detection sensor 33 serving as a sensor unit is installed on a rotation path of the detection member 34. Thus, the second embodiment will be described, focusing on differences from the first embodiment, i.e., the detection member 34 and detection sensor 33. In the second embodiment, components similar to those of the image forming apparatus 100 according to the first embodiment are denoted by the same reference numerals as the corresponding components, and description thereof will be omitted. Thus, in the second embodiment, components similar to those of the first embodiment provide advantages similar to those of the first embodiment.

An overall structure of the image forming apparatus 100A according to the second embodiment will be described with the aid of FIG. 1. As illustrated in FIGS. 1, 14A and 14B, the image forming apparatus 100A according to the second embodiment includes the sheet feeding unit 8, the image forming unit 14, the fixing unit 10, a sheet conveying unit 9A and the sheet delivery unit 13. The sheet conveying unit 9A includes the sheet conveying path 15*a*, duplex conveying path 15*b*, oblique feeding roller pair 16, U-turn roller pair 17 and skew correction unit 200A.

As illustrated in FIGS. 15A to 15D, the skew correction unit 200A includes the conveying roller pairs 18, 19, paper feed frame 20, conveying rotary member springs 21, shutter shaft 22, shutter members 23, assist cam 24, rotation assist roller 25 and shutter drive unit 26. Also, the skew correction unit 200A includes the shutter spring 27, the guide frame 28, the detection sensor 33 serving as a sensor unit, and the detection member 34 serving as a rotation detection unit.

The detection member 34 is fixed to the shutter shaft 22 by a spring pin (not illustrated) or the like and adapted to rotate integrally with the shutter shaft 22, shutter members 23 and assist cam 24. That is, the detection member 34 rotates integrally with the shutter members 23 by being placed coaxially with the shutter members 23.

The detection sensor 33 is an optical sensor (e.g., photosensor) attached on the paper feed frame 20 and made up of a light-emitting element and light-receiving element, forming an optical path L. The detection sensor 33 is placed on the rotation path of the detection member 34 and adapted to detect rotation of the detection sensor to a predetermined rotational position when the detection member 34 blocks the optical path L.

The skew correction unit 200A corrects skew of the sheet S using the shutter members 23 and detects leading end position of the sheet S when the light received by the detection sensor 33 is blocked by the detection member 34 which rotates together with the shutter members 23. When the skew correction unit 200A detects the leading end position of the sheet S, the image forming apparatus 100A according to the second embodiment causes the image forming unit 14 to start image formation.

Operation of the skew correction unit 200A will be described with reference to FIGS. 15A to 16D. Before the leading end of the sheet S comes into contact with the abutting surfaces 23*b* of the abutting portions 23*a* of the shutter members 23, the shutter spring 27 and shutter drive unit 26 are resting in equilibrium as illustrated in FIG. 15A. As illustrated in FIG. 15D, the shutter members 23 are waiting at the waiting position to detect the leading end of the sheet S. As illustrated in FIG. 15C, the assist cam 24 is similarly resting without being engaged with the rotation assist roller 25. During this period, the optical path L of the detection sensor 33 is not blocked by the detection member 34 as illustrated in FIG. 15B, and thus transmits light.

After the leading end of the sheet S comes into contact with the abutting surfaces 23*b* of the abutting portions 23*a*, when the shutter members 23 rotate and the sheet S is conveyed by the conveying roller pairs 18, 19, the detection member 34 blocks the optical path L of the detection sensor 33 as illustrated in FIG. 16B. When the optical path L of the detection sensor 33 is blocked by the detection member 34, the detection sensor 33 determines that the leading end of the sheet S has reached a predetermined position and transmits a predetermined detection signal to the image forming unit 14. Upon receiving the detection signal, the image forming unit 14 starts image formation.

Subsequently, the shutter spring 27, shutter members 23 and assist cam 24 operate similarly to the first embodiment. The detection member 34 performs a rotating operation similar to the shutter members 23 according to the first embodiment, and when the rear end of the sheet S separates from the shutter members 23 by passing through the waiting position, the detection member 34 waits again at the waiting position to detect the leading end of the subsequent sheet S. According to the second embodiment, a driving force is transmitted to the assist cam 24 from the rotation assist roller 25 attached on the rotating shaft 19*a*. The rotation assist roller 25 transmits the driving force to the assist cam 24 via the passing sheet S.

With the above-described configuration, the image forming apparatus 100A according to the second embodiment provides the following advantages. The skew correction unit 200A according to the second embodiment includes the detection sensor 33 and the detection member 34 which operates integrally with the shutter members 23. This allows the skew correction unit 200A not only to make a skew correction to the sheet S by using the shutter members 23, but also to detect the leading end position of the sheet S. Consequently, the image forming apparatus 100A can synchronize timing of image formation by the image forming unit 14 with the operation of the shutter members 23. This eliminates the need to provide a separate sheet detection unit to detect the leading end position of the sheet S, enabling reductions in production costs and the like. Since the rotation assist roller 25 is attached on the rotating shaft 19*a*, the image forming apparatus 100A can be configured to be smaller in size than the first embodiment.

Third Embodiment

Figure 17A:
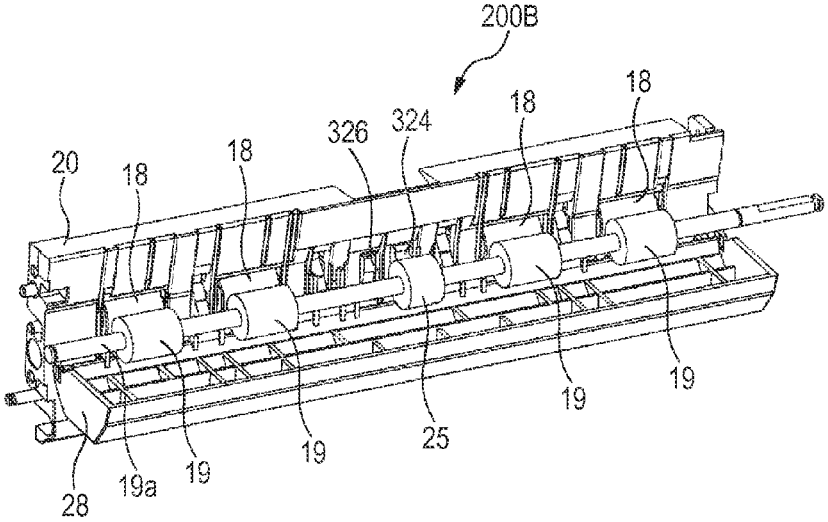
FIG. 17A is a perspective view of a skew correction unit according to a third embodiment, as viewed from the front.
Figure 17B:
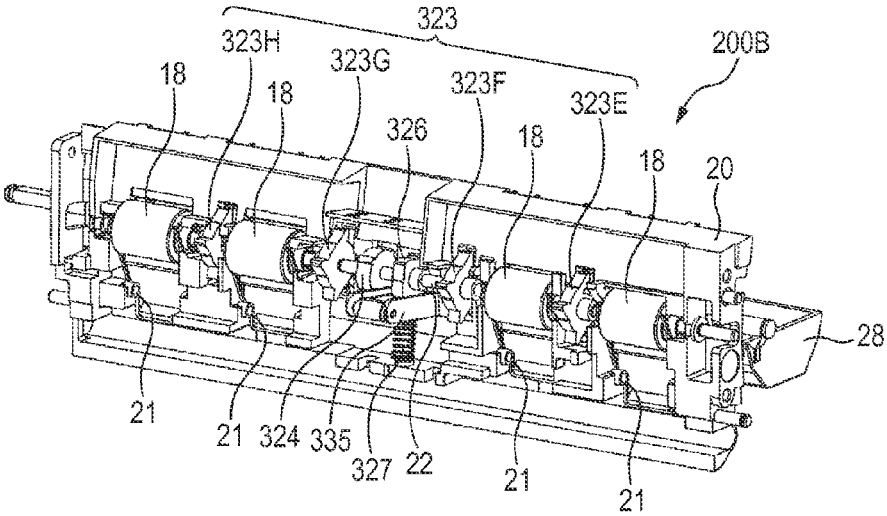
FIG. 17B is a perspective view of the skew correction unit illustrated in FIG. 17A, as viewed from the back.
Figure 18A:
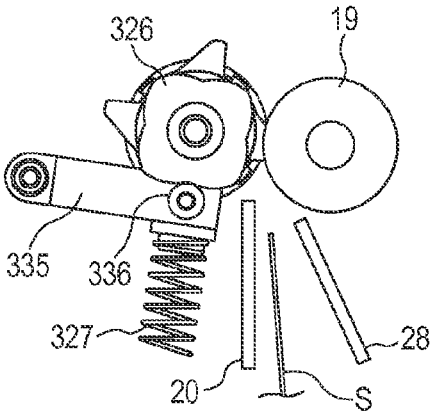
FIG. 18A illustrates a state of a shutter cam, shutter spring, pressing member and cam follower when a sheet is conveyed to the skew correction unit according to the third embodiment.
Figure 18B:
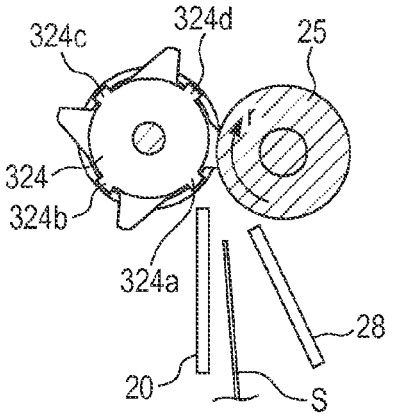
FIG. 18B illustrates a state of an assist cam and rotation assist roller.
Figure 18C:
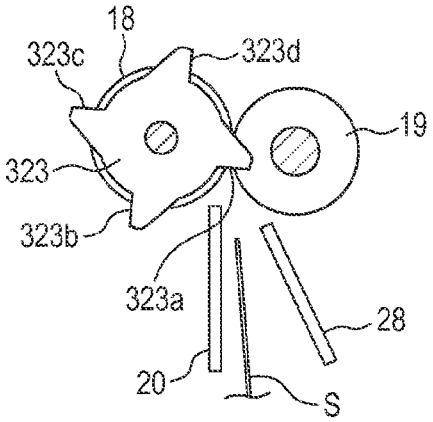
FIG. 18C illustrates a shutter member.

An image forming apparatus 100B according to a third embodiment of the present invention will be described with reference to FIGS. 17A to 20C and with the aid of FIG. 1. FIG. 17A is a perspective view of a skew correction unit 200B according to the third embodiment, as viewed from the front. FIG. 17B is a perspective view of the skew correction unit 200B illustrated in FIG. 17A, as viewed from the back. FIG. 18A illustrates a state of a shutter cam 326, shutter spring 327, pressing member 335 and cam follower 336 when a sheet S is conveyed to the skew correction unit 200B according to the third embodiment. FIG. 18B illustrates a state of an assist cam 324 and the rotation assist roller 25 when a sheet S is conveyed to the skew correction unit 200B according to the third embodiment. FIG. 18C illustrates a shutter member 323 when a sheet S is conveyed to the skew correction unit 200B according to the third embodiment.

Figure 19A:
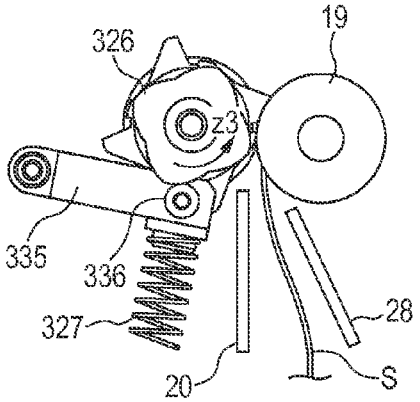
FIG. 19A illustrates a state of the shutter cam, shutter spring, pressing member and cam follower when the shutter member starts to rotate with the rotation assist roller engaged with the assist cam.
Figure 19B:
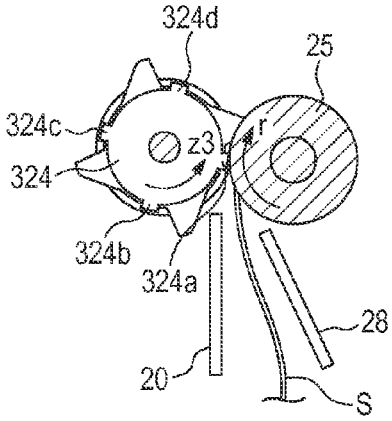
FIG. 19B illustrates a state of the assist cam and rotation assist roller.
Figure 19C:
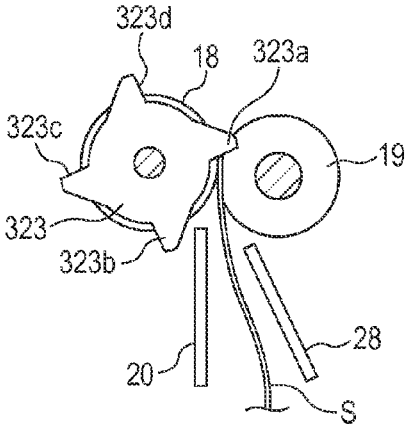
FIG. 19C illustrates a shutter member.
Figure 20A:
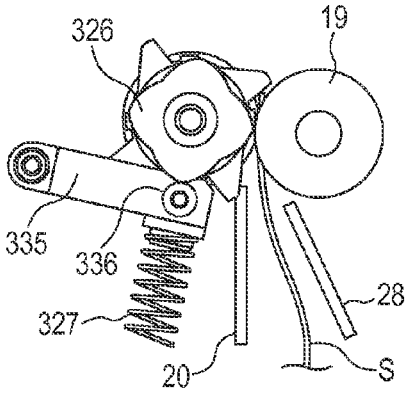
FIG. 20A illustrates a state of the shutter cam, shutter spring, pressing member and cam follower when the shutter member rotates with the rotation assist roller engaged with the assist cam.
Figure 20B:
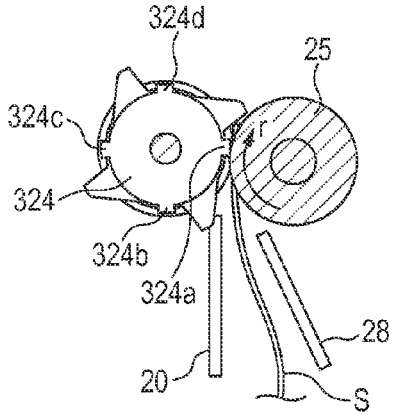
FIG. 20B illustrates a state of the assist cam and rotation assist roller.
Figure 20C:
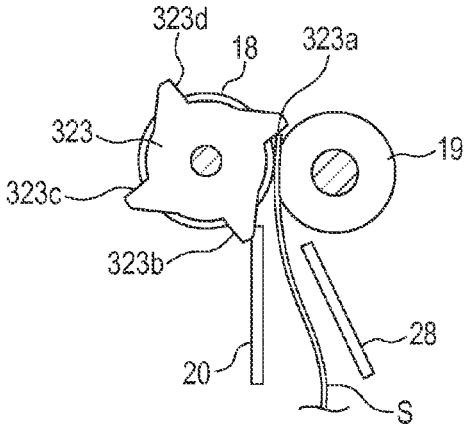
FIG. 20C illustrates a shutter member.

FIG. 19A illustrates a state of the shutter cam 326, shutter spring 327, pressing member 335 and cam follower 336 when the shutter member 323 starts to rotate with the rotation assist roller 25 engaged with the assist cam 324. FIG. 19B illustrates a state of the assist cam 324 and rotation assist roller 25 when the shutter member 323 starts to rotate with the rotation assist roller 25 engaged with the assist cam 324. FIG. 19C illustrates the shutter member 323 when the shutter member 323 starts to rotate with the rotation assist roller 25 engaged with the assist cam 324. FIG. 20A illustrates a state of the shutter cam 326, shutter spring 327, pressing member 335 and cam follower 336 when the shutter member 323 rotates with the rotation assist roller 25 engaged with the assist cam 324. FIG. 20B illustrates a state of the assist cam 324 and rotation assist roller 25 when the shutter member 323 rotates with the rotation assist roller 25 engaged with the assist cam 324. FIG. 20C illustrates the shutter member 323 when the shutter member 323 rotates with the rotation assist roller 25 engaged with the assist cam 324.

The image forming apparatus 100B according to the third embodiment differs from the first embodiment in that the rotation assist roller is placed on the rotating shaft 19*a* and that the shutter cam 326, shutter spring 327, pressing member 335 and cam follower 336 are provided to apply an urging force to the shutter members 323. Thus, the third embodiment will be described, focusing on differences from the first embodiment. In the third embodiment, components similar to those of the image forming apparatus 100 according to the first embodiment or image forming apparatus 100A according to the second embodiment are denoted by the same reference numerals, and description thereof will be omitted. Thus, in the third embodiment components similar to those of the first embodiment or second embodiment provide advantages similar to those of the first embodiment or second embodiment.

An overall structure of the image forming apparatus 100B according to the third embodiment will be described with the aid of FIG. 1. As illustrated in FIGS. 1, 17A and 17B, the image forming apparatus 100B according to the third embodiment includes the sheet feeding unit 8, the image forming unit 14, the fixing unit 10, a sheet conveying unit 9B and the sheet delivery unit 13. The sheet conveying unit 9B includes the sheet conveying path 15*a*, the duplex conveying path 15*b*, the oblique feeding roller pair 16, the U-turn roller pair 17 and a skew correction unit 200B.

As illustrated in FIGS. 17A and 17B, the skew correction unit 200B includes the conveying roller pairs 18, 19, paper feed frame 20, conveying rotary member springs 21, shutter shaft 22, shutter members 323, assist cam 324, rotation assist roller 25 and shutter cam 326. Also, the skew correction unit 200B includes the shutter spring 327, pressing member 335, cam follower 336 and guide frame 28.

Each shutter member 323 has four abutting portions 323*a*, 323*b*, 323*c* and 323*d*, on each of which an abutting surface has been formed. The assist cam 324 is provided with a plurality of protrusions 324*a*, 324*b*, 324*c* and 324*d* to engage with the rotation assist roller 25. The shutter cam 326, shutter members 323 and assist cam 324 are fixed to the shutter shaft 22 and adapted to rotate integrally with the shutter shaft 22. Also, the shutter cam 326, shutter spring 327, pressing member 335 and cam follower 336 apply an urging force to the shutter members 323.

The skew correction unit 200B holds the plurality of abutting portions 323*a*, 323*b*, 323*c* and 323*d* provided on the shutter members 323 in the waiting position by using the shutter cam 326, shutter spring 327, pressing member 335 and cam follower 336. The plurality of abutting portions 323*a*, 323*b*, 323*c* and 323*d* allow skew of the sheet S to be corrected without rotating the shutter members 323 a whole turn.

Operation of the skew correction unit 200B will be described with reference to FIGS. 18A to 20C. Before the leading end of the sheet S comes into contact with the abutting portions 323*a* provided on the shutter members 323, the shutter cam 326 is pressed by an urging force of the shutter spring 327 as illustrated in FIG. 18A. As illustrated in FIG. 18C, the shutter members 323 are waiting at rest at the waiting position in order for the leading end of the sheet S to be aligned. Also, as illustrated in FIG. 18B, the protrusions 324*a*, 324*b*, 324*c* and 324*d* of the assist cam 324 are waiting away from the rotation assist roller 25.

Next, after a skew correction is made with the leading end of the sheet S abutted against the abutting portions 323*a*, when the sheet S is conveyed by the conveying roller pairs 18, 19, the shutter cam 326 swings in the direction of an arrow z3, moving together with the shutter members 323 pushed up by the stiffness of the sheet S. At the same time, the protrusion 324*a* of the assist cam 324 comes into engagement with the rotation assist roller 25 as illustrated in FIG. 19B.

Once the protrusion 324*a* of the assist cam 324 engages with the rotation assist roller 25, the assist cam 324 rotates in the z3 direction by the rotational driving force of the rotation assist roller 25 in the r direction as illustrated in FIG. 19B. Consequently, the shutter cam 326 and shutter members 323 also rotate in the same direction.

When the shutter cam 326 rotates further, the shutter cam 326 passes the top dead center as illustrated in FIG. 20A. Almost at the same time as the shutter cam 326 passes the top dead center, the protrusion 324*a* of the assist cam 324 is disengaged from the rotation assist roller 25 as illustrated in FIG. 20B. Once the protrusion 324*a* of the assist cam 324 is disengaged from the rotation assist roller 25, the assist cam 324 and shutter members 323 come into contact with the surface of the sheet S under the urging force of the shutter cam 326 and shutter spring 327 in an attempt to start rotating to the waiting position. However, since the sheet S is conveying, the assist cam 324 and shutter members 323 are unable to rotate and wait in this state.

Next, when the rear end of the sheet S passes through the waiting position, the assist cam 324 and shutter members 323 rotate toward the waiting position and placed in the waiting position. According to the third embodiment, four protrusions 324*a*, 324*b*, 324*c* and 324*d* are formed on the assist cam 324 and four abutting portions 323*a*, 323*b*, 323*c* and 323*d* are formed on the shutter members 323. Consequently, when the operations described above are performed in sequence, along with the feeding of the sheet S, the protrusions of the assist cam 324 as well as the abutting portions of the shutter members sequentially move and are used. For example, the shutter members are used in order of the abutting portion 323*a*, abutting portion 323*b*, abutting portion 323*c*, abutting portion 323*d* and abutting portion 323*a*. On the other hand, the protrusions of the assist cam 324 are used, for example, in order of the protrusion 324*a*, protrusion 324*b*, protrusion 324*c*, protrusion 324*d* and protrusion 324*a*.

With the above-described configuration, the image forming apparatus 100B according to the third embodiment provides the following advantages in addition to the advantages provided by the same configuration as the first embodiment. In the skew correction unit 200B according to the third embodiment, the four abutting portions 323*a*, 323*b*, 323*c* and 323*d* are provided on the shutter member 323 and the four protrusions 324*a*, 324*b*, 324*c* and 324*d* are formed on the assist cam 324. Consequently, the skew correction unit 200B can correct skew of the sheet S without rotating the shutter members 323 a whole turn. This reduces the time needed to place the abutting portions in the waiting position, and thereby increasing the sheet gap distance is suppressed when conveying speed of the sheet S is increased. This in turn allows improvements in throughput.

Although the skew correction unit 200B according to the third embodiment is configured to urge the shutter members 323 by the shutter spring and assist cam, rotation assist effects of the assist cam 324 can assist force for the shutter members 323 past the top dead center of the cam. This eliminates the need to rely solely on the stiffness of the sheet S for the force needed to push the shutter members 323 and thereby prevents the leading end of the sheet from damage such as flaws or curling.

Embodiments of the present invention have been described above, but the present invention is not limited to the embodiments described above. Also, only major advantages of the present invention have been listed in the above embodiments, and the advantages of the present invention are not limited to those described in the embodiments.

For example, although in the first embodiment, the plurality of shutter members 23 and the assist cam 24 are fixed to the shutter shaft 22, the present invention is not limited to this. For example, the plurality of shutter members 23, the assist cam 24, the shutter shaft 22 and the shutter drive unit 26 may be constructed integrally. Alternatively, one of the shutter members 23 may be constructed integrally with the assist cam 24.

Figure 21:
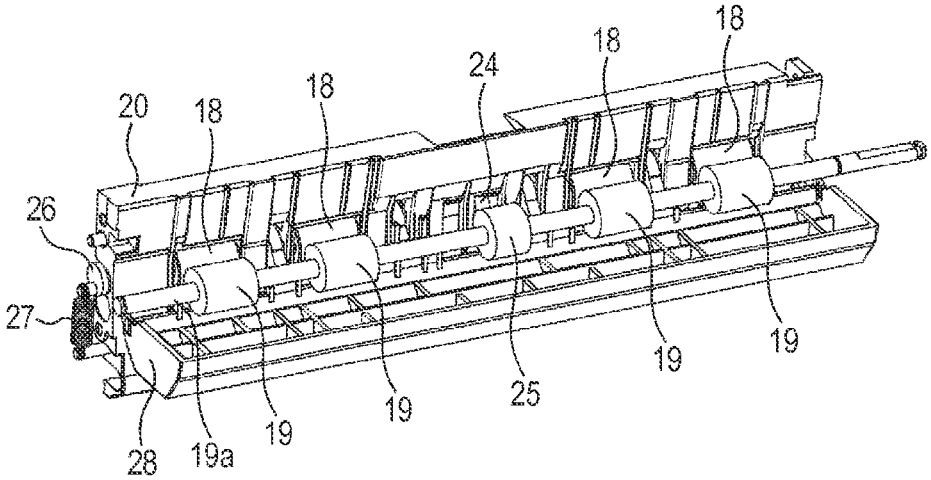
FIG. 21 is a perspective view illustrating another form of the skew correction unit according to the first embodiment.
Figure 22:
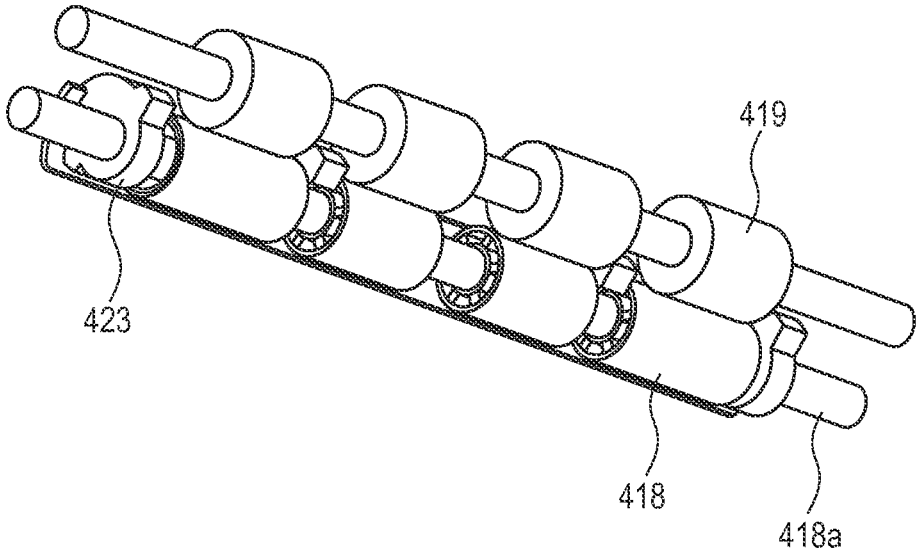
FIG. 22 schematically illustrates a shutter member of the skew correction unit.
Figure 23:
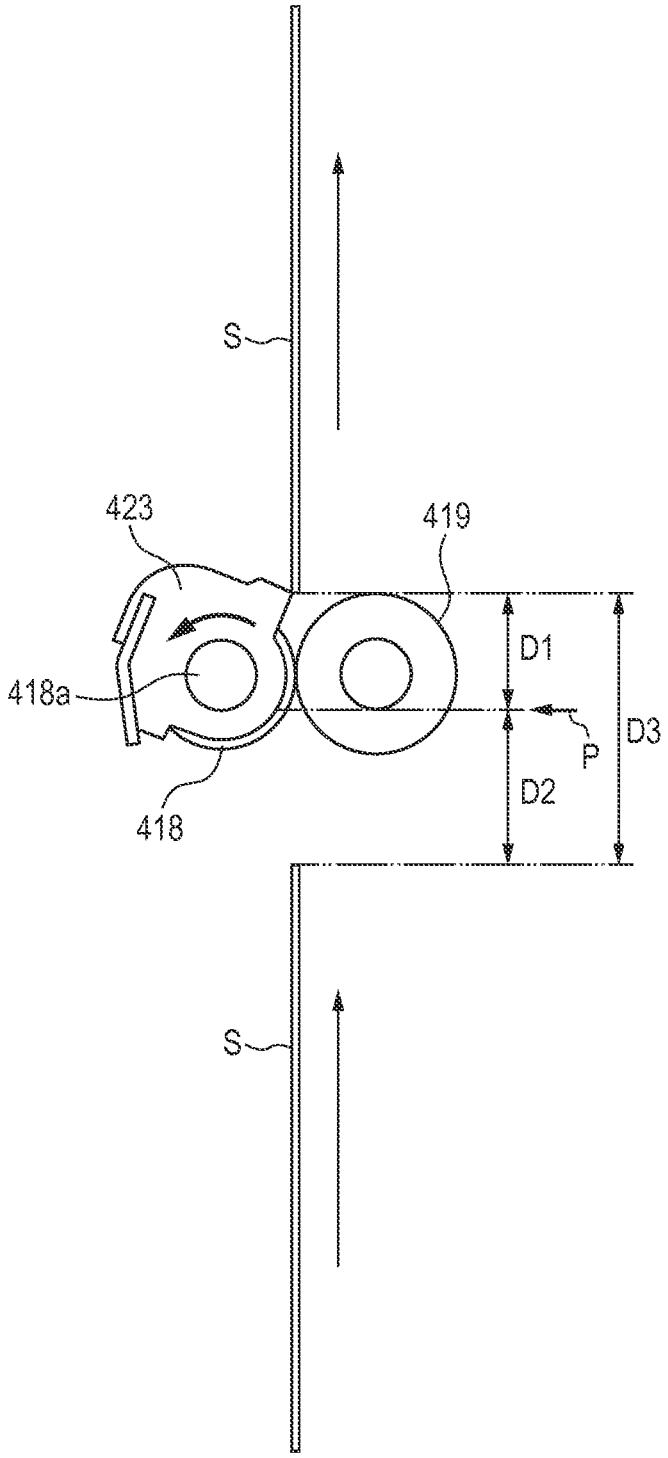
FIG. 23 schematically illustrates a form of the skew correction unit according to the first embodiment.

Although the rotation assist roller is placed independently in the first embodiment, the rotation assist roller 25 may be attached on the rotating shaft 19*a* of the conveying rollers 19 and placed so as to face the assist cam 24, for example, as illustrated in FIG. 21. This reduces costs and space compared to when the rotation assist roller is placed independently.

Although in the first embodiment, the urging force is applied by the shutter spring 27 in order for the shutter members 23 to wait at the waiting position, the present invention is not limited to this. For example, the weight balance of the shutter members 23 may be adjusted to configure the shutter members 23 to wait at the waiting position by the force of gravity.

Although in the second embodiment, the detection member 34 is placed independently, the present invention is not limited to this. For example, the detection member 34 may be constructed integrally with the assist cam 24 and shutter members 23.

Although in the second embodiment, the sheet S is detected using the detection member 34 and detection sensor 33 and an image is formed so as to synchronize with the sheet based on a signal from the detection sensor 33, the present invention is not limited to this. For example, the present invention may be configured to form an image first and then adjust the position of the sheet to the image when the sheet S is detected by the detection sensor 33. Alternatively, the present invention may be configured such that only conveying delays or jams of sheets S will be detected.

Although the plurality of shutter members 323, the assist cam 324 and the shutter cam 326 are fixed to the shutter shaft 22 in the third embodiment, the present invention is not limited to this. For example, the plurality of shutter members 323, the assist cam 324, the shutter shaft 22 and the shutter cam 326 may be constructed integrally. Alternatively, one of the shutter members 323 may be constructed integrally with the assist cam 324 or shutter cam 326.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-230414, filed Oct. 13, 2010, which is hereby incorporated by reference herein in its entirety.

What is claimed is:

1. A sheet conveying apparatus for correcting a skew of a conveyed sheet, comprising:

a shutter unit rotatably provided and having an abutting portion against which a leading end of the conveyed sheet abuts at a waiting position, wherein the shutter unit is rotated in a predetermined rotation direction by being pushed by the leading end of the conveyed sheet, and then the shutter unit is further rotated toward the waiting position in the predetermined rotation direction;

a conveying unit configured to convey the sheet while nipping the sheet, wherein the conveying unit is arranged such that, the leading end of the sheet is nipped by the conveying unit while the shutter unit is rotated in the predetermined rotation direction by being pushed by the leading end of the conveyed sheet which abuts against the abutting portion;

a rotation transmitting unit configured to transmit a rotational driving force to the shutter unit to rotate the shutter unit in the predetermined rotation direction, the rotation transmitting unit starting to transmit the rotational driving force to the shutter unit after the shutter unit rotates until the sheet is nipped by the conveying unit with the abutting portion pushed by the leading end of the sheet, and the rotation transmitting unit configured to release transmission of the rotational driving force while rotating the shutter unit to the waiting position; and an urging unit configured to apply an urging force for rotating the shutter unit in the predetermined direction so that the shutter unit, to which the rotational driving force has been transmitted by the rotation transmitting unit, is located at the waiting position.

2. The sheet conveying apparatus according to claim 1, wherein, the rotation transmitting unit comprises:

a rotating unit configured to generate the rotational driving force to rotate the shutter unit; and a transmitting unit coupled to the shutter unit and configured to transmit the rotational driving force to the shutter unit by engaging with the rotating unit, wherein, after the shutter unit rotates until the sheet is nipped by the conveying unit with the abutting portion pushed by the leading end of the sheet, the transmitting unit engages with the rotating unit and applies the rotational driving force to the shutter unit to rotate the shutter unit in the predetermined rotation direction, and the transmitting unit disengages with the rotating unit in a state in which the shutter unit contacts with the surface of the passing sheet by the urging force of the urging unit.

3. The sheet conveying apparatus according to claim 1, further comprising:

a rotation detection unit provided coaxially with the shutter unit and rotating integrally with the shutter unit; and a sensor unit provided in a rotation path of the rotation detection unit and detecting the rotation detection unit rotated to a predetermined rotational position.

4. The sheet conveying apparatus according to claim 1, wherein, the conveying unit is a roller pair, and wherein the rotation transmitting unit is attached on a shaft of a driving roller which is one roller of the roller pair, and has a rotating unit transmitting the rotational driving force to the shutter unit via the sheet nipped and conveyed by the roller pair.

5. An image forming apparatus comprising:

the sheet conveying apparatus according to claim 1; and an image forming unit forming an image on the sheet sent out of the sheet conveying apparatus.

6. The image forming apparatus according to claim 5, wherein, the rotation transmitting unit comprises:

a rotating unit configured to generate the rotational driving force to rotate the shutter unit; and a transmitting unit coupled to the shutter unit and configured to transmit the rotational driving force to the shutter unit by engaging with the rotating unit, wherein, after the shutter unit rotates until the sheet is nipped by the conveying unit with the abutting portion pushed by the leading end of the sheet, the transmitting unit engages with the rotating unit and applies the rotational driving force to the shutter unit to rotate the shutter unit in the predetermined rotation direction, and the transmitting unit disengages with the rotating unit in a state in which the shutter unit contacts with the surface of the passing sheet by the urging force of the urging unit.

7. The image forming apparatus according to claim 5, further comprising:

a rotation detection unit provided coaxially with the shutter unit and rotating integrally with the shutter unit; and a sensor unit provided in a rotation path of the rotation detection unit and detecting the rotation detection unit rotated to a predetermined rotational position.

8. The image forming apparatus according to claim 5, wherein, the conveying unit is a roller pair, and wherein the rotation transmitting unit is attached on a shaft of a driving roller which is one roller of the roller pair, and has a rotating unit transmitting the rotational driving force to the shutter unit via the sheet nipped and conveyed by the roller pair.

9. The sheet conveying apparatus according to claim 1, wherein the shutter unit, to which the rotational driving force has been transmitted by the rotation transmitting unit, comes into contact with a surface of the conveyed sheet, and the shutter unit rotates in the predetermined direction by the urging force applied by the urging unit to be located at the waiting position along with the passage of a rear end of the sheet through the shutter unit.

10. The sheet conveying apparatus according to claim 1, wherein the urging unit applies the urging force to the shutter unit so that the shutter unit comes into contact with a surface of the passing sheet after the rotation transmitting unit, which transmits the rotational driving force to the shutter unit, releases the transmission of the rotational driving force.

11. The sheet conveying apparatus according to claim 1, wherein the shutter unit rotates in the predetermined direction by the urging force applied by the urging unit to be located at the waiting position along with the passage of a rear end of the sheet through the shutter unit.

12. The sheet conveying apparatus according to claim 10, wherein the shutter unit rotates in the predetermined direction by the urging force applied by the urging unit to be located at the waiting position along with the passage of a rear end of the sheet through the shutter unit.

13. The sheet conveying apparatus according to claim 1, wherein the rotation transmitting unit releases the transmission of the rotational driving force when the shutter unit is at the waiting position.

14. The sheet conveying apparatus according to claim 1, wherein, the rotation transmitting unit comprises:

a rotating unit configured to generate the rotational driving force to rotate the shutter unit; and a transmitting unit coupled to the shutter unit and configured to transmit the rotational driving force to the shutter unit by engaging with the rotating unit, and wherein the rotating unit disengages with the transmitting unit when the shutter unit is at the waiting position.

15. The sheet conveying apparatus according to claim 1, wherein, the rotation transmitting unit comprises:

a rotating unit configured to generate the rotational driving force to rotate the shutter unit; and a transmitting unit coupled to the shutter unit and configured to transmit the rotational driving force to the shutter unit to rotate the shutter unit in the predetermined rotation direction by engaging with the rotating unit after the shutter unit rotates until the sheet is nipped by the conveying unit with the abutting portion pushed by the leading end of the sheet, wherein the urging unit applies the urging force for rotating the shutter unit, to which the rotational driving force has been transmitted by the transmitting unit, in the predetermined direction toward the waiting position in a state in which engagement of the rotating unit and the transmitting unit is released.

16. The sheet conveying apparatus according to claim 1, wherein the urging force of the urging unit acts on the shutter unit as a reactive force against the leading end of the sheet while the leading end of the sheet that is being conveyed is rotating the shutter unit, and that, after the leading end of the sheet has been nipped by the conveying unit, a direction in which the urging force of the urging unit is made to act on the shutter unit is changed to such a direction that the shutter unit is rotated in the predetermined rotation direction.

17. The sheet conveying apparatus according to claim 16, wherein, after the leading end of the sheet has been nipped by the conveying unit, the rotation transmitting unit transmits the rotational driving force to the shutter unit to rotate the shutter unit in the predetermined rotation direction until the direction in which the urging force of the urging unit is made to act on the shutter unit is changed to such the direction that the shutter unit is rotated in the predetermined rotation direction.

18. The sheet conveying apparatus according to claim 1, wherein the shutter unit has a connecting portion arranged offset with respect to a rotation center of the shutter unit, and the urging unit has a spring, one end of the spring being positionally-fixed and another end of the spring being connected to the connecting portion so that the connecting portion passes over a top dead center in the middle of the rotation of the shutter unit, to locate the shutter unit at the waiting position.

19. The sheet conveying apparatus according to claim 1, wherein the shutter unit is one of a plurality of shutter units which are aligned in a sheet width direction, and each of the plurality of shutter units has the abutting portion, and the conveyed sheet is nipped by the conveying unit while the plurality of shutter units are integrally rotated by being pushed by the conveyed sheet of which the leading end abuts against the respective abutting portions of the plurality of shutter units.

20. A sheet conveying apparatus for correcting a skew of a conveyed sheet, comprising:

a shutter unit rotatably provided, and the shutter unit having an abutting portion against which a leading end of the conveyed sheet abuts at a waiting position and another abutting portion against which a leading end of a conveyed subsequent sheet abuts at the waiting position, wherein the shutter unit is rotated in a predetermined rotation direction by being pushed by the leading end of the conveyed sheet, and then the shutter unit is further rotated toward the waiting position in the predetermined rotation direction;

a conveying unit configured to convey the sheet while nipping the sheet, wherein the conveying unit is arranged such that, the leading end of the sheet is nipped by the conveying unit while the shutter unit is rotated in the predetermined rotation direction by being pushed by the leading end of the conveyed sheet which abuts against the abutting portion;

a rotation transmitting unit configured to transmit a rotational driving force to the shutter unit to rotate the shutter unit in the predetermined rotation direction, the rotation transmitting unit starting to transmit the rotational driving force to the shutter unit after the shutter unit rotates until the sheet is nipped by the conveying unit with the abutting portion pushed by the leading end of the sheet, and the rotation transmitting unit configured to release transmission of the rotational driving force while rotating the shutter unit to the waiting position; and an urging unit configured to apply an urging force for rotating the shutter unit in the predetermined direction so that the shutter unit, to which the rotational driving force has been transmitted by the rotation transmitting unit, is located at the waiting position.

* * * * *